US005535581A

United States Patent [19]

Tahara et al.

[11] Patent Number: 5,535,581

[45] Date of Patent: Jul. 16, 1996

[54] SLIVER CANS EXCHANGING SYSTEM AND SLIVER PIECING SYSTEM

[75] Inventors: Ryosuke Tahara, Kyoto; Hiroshi Tsuji, Joyo, both of Japan

[73] Assignee: Murata Kikai Kabushiki Kaisha, Kyoto, Japan

[21] Appl. No.: 230,247

[22] Filed: Apr. 20, 1994

[30] Foreign Application Priority Data

Apr. 22, 1993 [JP] Japan ..... 5-095809
Oct. 26, 1993 [JP] Japan ..... 5-290034

[51] Int. Cl.[6] ..... D01H 9/10; D04H 11/00

[52] U.S. Cl. ..... 57/281; 19/159 A; 57/261; 57/268; 57/269; 57/278; 414/608; 414/799

[58] Field of Search ..... 57/90, 281, 266, 57/269, 268, 271, 272, 278, 261; 19/159 A; 414/799, 922, 608, 662, 663, 664

[56] References Cited

U.S. PATENT DOCUMENTS 3,816,991 6/1974 Takeuchi et al. ..... 57/36
4,012,893 3/1977 Weber ..... 19/159 A
4,033,104 7/1977 Kamp ..... 57/34 R
4,150,534 4/1979 Raasch ..... 57/90
4,653,263 3/1987 Stahlecker et al. ..... 57/263
4,939,895 7/1990 Raasch et al. ..... 57/90
4,969,323 11/1990 Stahlecker ..... 57/90
4,982,563 1/1991 Stahlecker ..... 19/159 A
4,987,645 1/1991 Kawasaki et al. ..... 19/159 A
5,067,204 11/1991 Shinkai et al. ..... 57/266
5,207,555 5/1993 Shirai ..... 414/663
5,276,947 1/1994 Fritschi et al. ..... 57/281
5,323,598 6/1994 Stahlecker et al. ..... 57/315
5,375,958 12/1994 Kluttermann ..... 414/280

*Primary Examiner*—William Stryjewski
*Attorney, Agent, or Firm*—Armstrong, Westerman, Hattori, McLeland & Naughton

[57] ABSTRACT

A cans exchanging system whereby, out of cans arranged in plural rows in the longitudinal direction of a spinning frame, plural empty cans arranged in the direction orthogonal to the longitudinal direction of the spinning frame are carried out from the rows of cans, and plural full-loaded cans are carried in simultaneously to the carried-out position of the empty cans. A sliver piecing device for piecing together slivers, from sliver feeding cans to a spinning machine and slivers from full-loaded cans while carrying both cans on a cans exchanging carrier is mounted on the cans exchanging carrier.

16 Claims, 29 Drawing Sheets

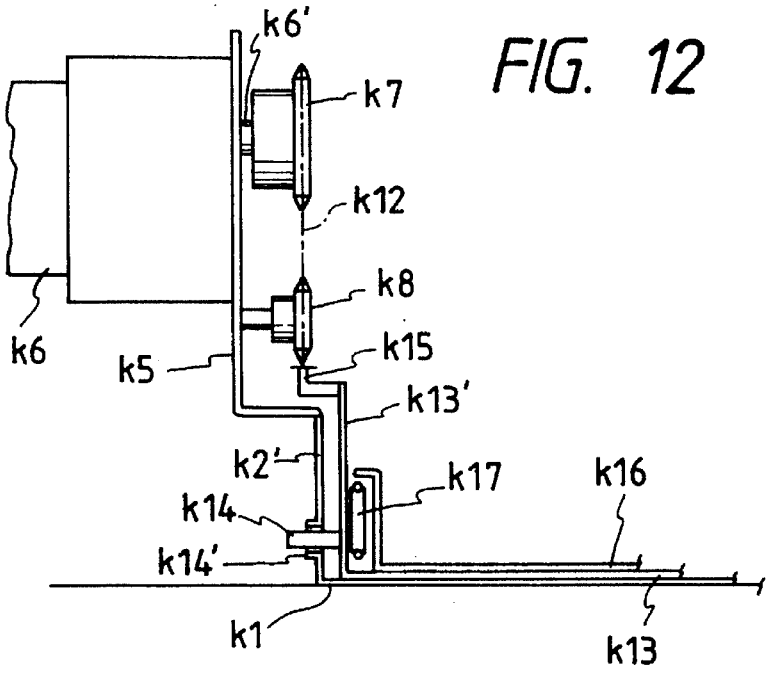
FIG. 12
FIG. 13A
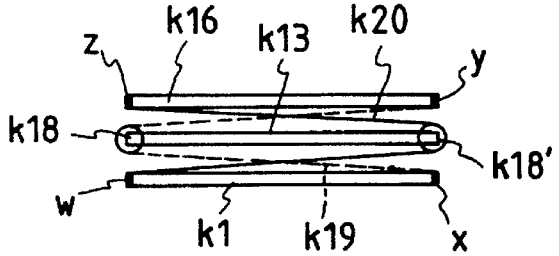
FIG. 13B
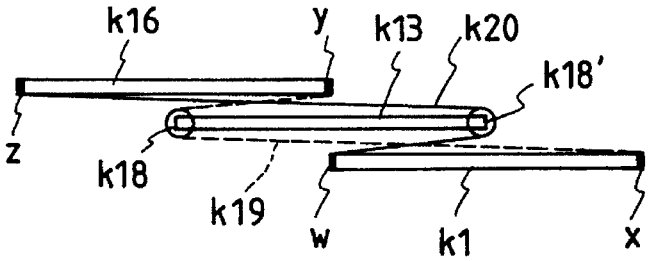
FIG. 13C
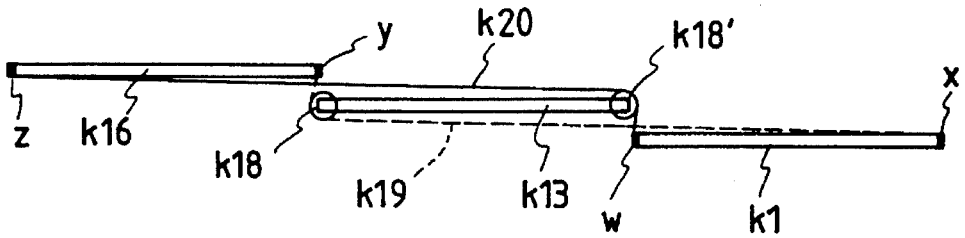

SLIVER CANS EXCHANGING SYSTEM AND SLIVER PIECING SYSTEM

BACKGROUND OF THE INVENTION

FIELD OF THE INVENTION

The present invention relates to a cans exchanging system for replacing empty cans with full-loaded cans when cans disposed in a drawing frame, a roving frame or a spinning frame have become empty.

Further, the present invention relates to a sliver piecing system whereby, when a certain can out of rows of cans disposed behind a spinning machine and containing sliver has become almost empty ("empty can" hereinafter) and when such an empty can is to be replaced with a can filled with sliver ("full-loaded can" hereinafter), an end portion of sliver ("old sliver" hereinafter) from the empty can to the spinning machine and that of sliver ("new sliver" hereinafter) contained in the full-loaded can are pieced together.

PRIOR ART

According to the prior art, when the cans disposed in a drawing frame, a roving frame or a spinning frame have become empty, a worker gets in between the empty cans and replaces them manually with full-loaded cans which are arranged, for example, behind the empty cans.

In the case where the spacing between cans arranged in the longitudinal direction of the body of a drawing frame, a roving frame or a spinning frame (hereinafter referred to also as "spinning machine") is large, it is possible for a worker to enter between the cans and perform a manual replacement of cans. However, in the case where the said spacing is narrow and cans are arranged in plural rows in the longitudinal direction of the spinning machine, it is very difficult to conduct a manual replacement of cans, and a considerable time will be required for the replacement. Further, where the spacing between adjacent spinning machines is made narrow to permit arrangement of a larger number of spinning machines, it is difficult to carry in large cans manually between the spinning machines and it is also difficult to carry in a large-sized working car which carries cans thereon.

Heretofore there has not been known a cans exchanging system capable of effecting efficiently and rapidly the replacement of cans in a spinning machine in which the cans are arranged through a narrow spacing and in plural rows in the longitudinal direction of the spinning machine.

According to the prior art, when a worker has confirmed a substantially empty condition of a sliver can, the worker stops the operation of the spinning unit concerned, then enters the space behind the spinning machine and pieces the old and new slivers together manually.

According to the prior art, in the case of replacing empty can and full-loaded can with each other and piecing slivers together, the operation of the spinning unit concerned is once stopped, and after completion of the can changing and sliver piecing work, the operation of the spinning unit is re-started, thus requiring control of the operation on the spinning machine side for example. Consequently, not only the control of the spinning machine is complicated but also the operation efficiency of the spinning machine is deteriorated because the spinning unit concerned must be once stopped.

Besides, not only the manual sliver piecing work is time-consuming, but also a wide space is required behind the spinning machine to permit the worker to perform the necessary work.

Moreover, since sliver is soft and easy to break, a considerable skill is needed for piecing slivers, and if the length or hardness of the resulting seam portion is not appropriate, there will occur a trouble such as breaking of sliver or the breaking of spun yarn.

Further, since it is necessary to ensure a wide space for the worker to get in behind the spinning machine and perform the sliver piecing work, a great limitation is placed on the arrangement of spinning machines, cans or sliver guide rollers.

SUMMARY OF THE INVENTION

It is the object of the present invention to solve the above-mentioned problems of the conventional cans exchanging system and provide a cans exchanging system capable of performing efficiently and rapidly the replacement of cans in a spinning machine in which the spacing between adjacent cans is narrow and in which cans are arranged in rows compactly.

According to the present invention, in order to achieve the above-mentioned object, there is provided a cans exchanging system wherein, out of cans arranged in plural rows in the longitudinal direction of a spinning frame, plural empty cans arranged in a direction orthogonal to the longitudinal direction of the spinning machine are carried out simultaneously, and plural full-loaded cans are carried in simultaneously to the carried-out position of the empty cans.

It is another object of the present invention to solve the above-mentioned problems of the conventional sliver piecing system and provide an automated sliver piecing system.

According to the present invention, in order to achieve the above-mentioned object, cans from which sliver is being fed to a spinning machine, as well as full-loaded cans, are carried on a cans exchanging carrier, and the slivers from the former cans and those from the latter, full-loaded cans are pieced together on the cans exchanging carrier.

BRIEF DESCRIPTION OF THE DRAWINGS

FIG. 12 is a partially enlarged front view of the can transfer device;

FIGS. 13A to 13C are views showing a wire stretching method;

DETAILED DESCRIPTION OF PREFERRED EMBODIMENTS

A first embodiment of the present invention will be described below with reference to FIGS. 1 to 8, provided no limitation is made thereto as long as the gist of the invention is observed.

First, with reference to FIG. 1 which is a schematic plan view showing an operation sequence of a cans doffing system embodying the present invention, the following description is provided about, as an example, in what sequence a plurality of empty cans are carried out simultaneously from rows of cans and a plurality of full-loaded cans are carried in simultaneously to the carried-out position of the empty cans in the case where out of cans arranged through a narrow spacing between adjacent cans and in plural rows in the longitudinal direction of a spinning frame, a plurality of cans arranged in a direction orthogonal to the longitudinal direction of the spinning frame have become empty ("empty cans" as referred to herein indicates not only cans completely free of sliver but also cans having a slight residue of sliver).

In FIG. 1, the reference mark S denotes a spinning frame, F and E denote cans, which are arranged behind the spinning frame S in two rows in the longitudinal direction of the spinning frame. Each can F represents a can which is feeding sliver to the spinning frame S, while each can E represents an empty can to be replaced with a full-loaded can filled with sliver. The mark V denotes a cans exchanging carrier. In the embodiment illustrated in FIG. 1, slivers are being fed simultaneously from the first row of cans (F and E with numeral 1 attached thereto) and the second row of cans (F and E with numeral 2), and cans E1 and F2 which have become empty are replaced with full-loaded cans simultaneously.

Figure 1A:
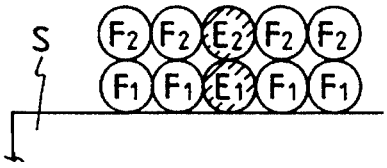
FIGS. 1A to 1F are schematic plan views showing an operation sequence of a cans exchanging system according to the present invention.

As shown in FIG. 1A, when empty condition of cans E1 and E2 has been detected by a suitable detection means such as, for example, an operating time controller provided on the spinning frame side or a photoelectric detector mounted on a traveling car which travels above the rows of cans or on the cans exchanging carrier V, the carrier V having full-loaded cans thereon by a number corresponding to the number of rows arranged in the direction orthogonal to the traveling direction and also having a space for the empty cans is introduced along the rows of cans and stops in front of the empty cans E1 and E2 in accordance with a command issued from a suitable controller. Since two rows of cans are shown in FIG. 1 as an example, two full-loaded cans are carried on the cans exchanging carrier, but cans may be arranged in three or more rows if necessary.

Figure 1B:
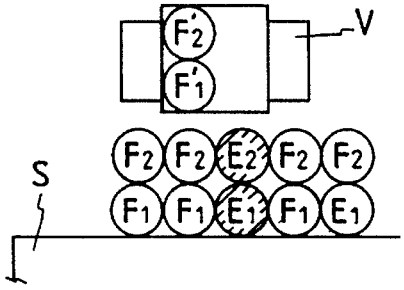

As shown in FIG. 1B, the cans exchanging carrier V stops in such a manner that its space for empty cans is positioned in front the empty cans E1 and E2.

Figure 1C:
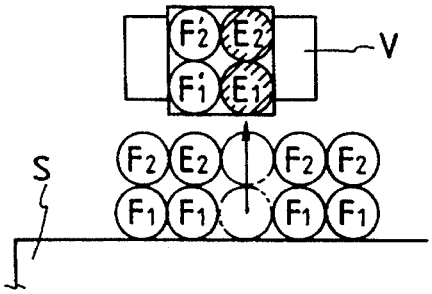

Next, the two empty cans E1 and E2 are put onto the cans exchanging carrier V simultaneously by means of a can transfer device mounted on the carrier V and which will be described later, as shown in FIG. 1C.

Figure 1D:
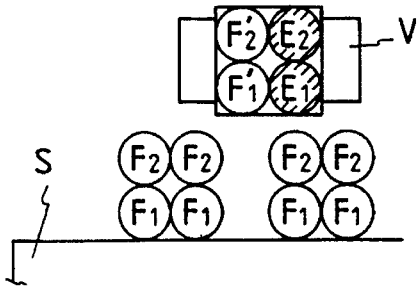

Then, as shown in FIG. 1D, the cans exchanging carrier V is moved so that full-loaded cans F1' and F2' on the carrier V are positioned in front of the carried-out position of the empty cans E1 and E2.

Figure 1E:
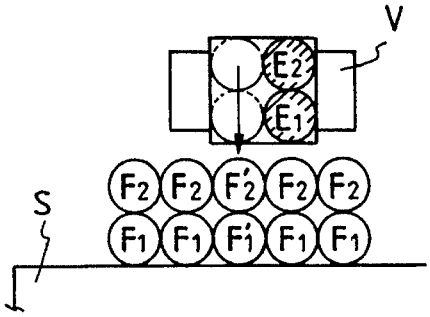
Figure 1F:
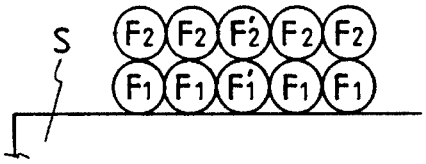

Then, as shown in FIG. 1E, the full-loaded cans F' and F2' are carried into the rows of cans simultaneously by the can transfer device on the carrier V. In this way, the change of the empty cans E1 and E2 for the full-loaded cans F1' and F2' is completed, as shown in FIG. 1F.

Thereafter, the cans exchanging carrier V returns to a full-loaded can replenishing station, where it discharges the empty cans E1 and E2 and receives full-loaded cans, followed by moving to a place requiring the replacement of cans.

In accordance with such a sequence there is conducted replacement of empty cans E1, E2 with full-loaded cans F1', F2'.

Now, with reference to FIGS. 2 and 3 which are schematic side views of cans and the cans exchanging carrier V, the following description is provided about in what sequence the empty cans E1 and E2 are put onto the carrier V by the can transfer device mounted on the carrier and in what sequence the full-loaded cans F1' and F2' on the carrier V are carried into the rows of cans.

In FIGS. 2 and 3, the reference mark M denotes the said can transfer device mounted on the cans exchanging carrier V and which will be described later, p1 denotes an upper presser member disposed on the carrier V and which will be described later, p2 denotes a lower presser member to be described later, which is disposed on the carrier V, and h denotes a stopper fixed onto the floor to prevent cans from moving toward the spinning frame S side.

Figure 2A:
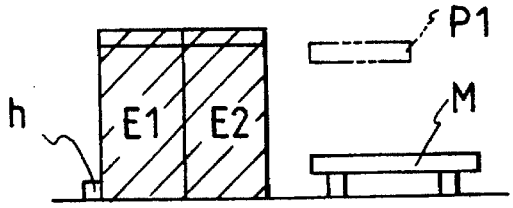
FIGS. 2A to 2E are schematic side views showing in what sequence empty cans are carried out from rows of cans and are then placed on a cans exchanging carrier.
Figure 2B:
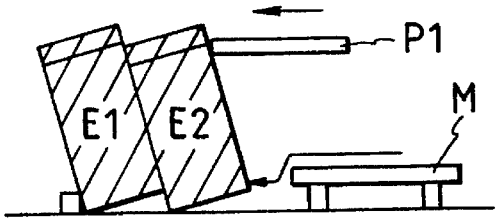

When the cans exchanging carrier V stops in such a manner that the space for empty cans on the carrier V is positioned in front of the empty cans E1 and E2 as mentioned above, the upper presser member p1 on the carrier advances as shown in FIG. 2A and pushes the upper portions of the empty cans E1 and E2, allowing them to be tilted, as shown in FIG. 2B. In this case, a lower end part of the side face of the tilted empty can E1 comes into abutment with the stopper h to prevent the movement toward the spinning frame S, so that the empty cans E1 and E2 are sure to be tilted with the forward movement of the upper presser member p1.

Figure 2C:
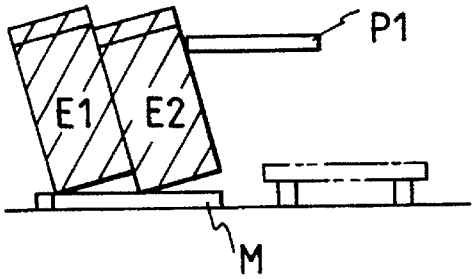

Next, as shown in FIGS. 2B and 2C, the can transfer device M on the cans exchanging carrier V advances and is inserted between the bottom faces of the tilted empty cans E1, E2 and the floor.

Figure 2D:
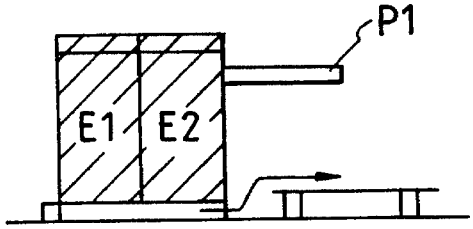
Figure 2E:
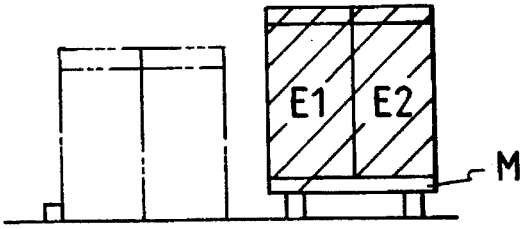

Then, as shown in FIG. 2D, the upper presser member p1 retreats, thereby allowing the empty cans E1 and E2 revert to their original upright state and placed onto the can transfer device M, then the device M moves back to accommodate the empty cans E1 and E2 in the cans exchanging carrier V, as shown in FIG. 2E.

Figure 3A:
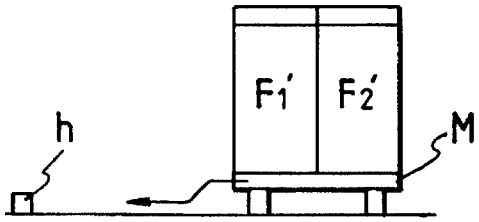
FIGS. 3A to 3E are schematic side views showing in what sequence full-loaded cans on the cans exchanging carrier are carried into the rows of cans.
Figure 3B:
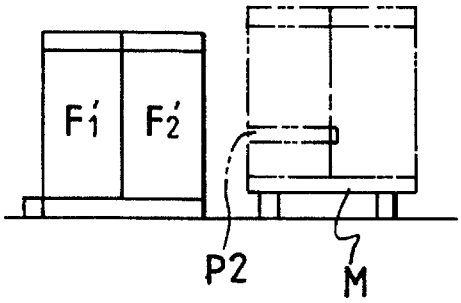

Then, as mentioned above, the carrier V is moved so that the full-loaded cans F1' and F2' thereon are positioned in front of the carried-out position of the empty cans E1 and E2. At the same time, the can transfer device M which carries the full-loaded cans F1' and F2' advances until those full-loaded cans are carried to the carried-out position of the empty cans E1 and E2, as shown in FIGS. 3A and 3B.

Figure 3C:
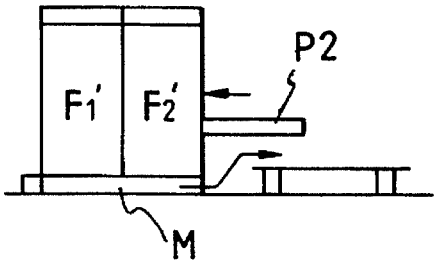

Next, as shown in FIG. 3C, the lower presser member p2 on the cans exchanging carrier V advances until its contact with the full-loaded can F2'.

Figure 3D:
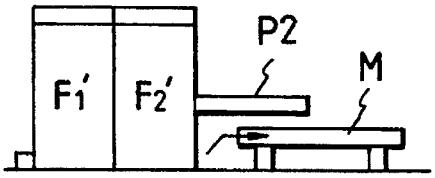
Figure 3E:
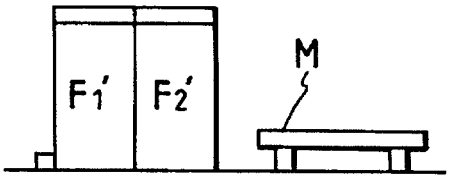

Then, the can transfer device M is moved back, as shown in FIG. 3D. In this case, since the movement of the full-loaded can F2' is prevented by the lower presser member p2, only the can transfer device M moves back, whereby the full-loaded cans F1' and F2' are carried to the carried-out position of the empty cans E1 and E2, as shown in FIG. 3E. Now, ones cans exchanging cycle is over.

The can transfer device M mounted on the cans exchanging carrier V will be described below with reference to FIG. 4 which is a perspective view of the device M.

In the same figure m1 and m1' denote frames of the cans exchanging carrier V. From the frame m1 is suspended an upper frame portion m2. The lower end of the upper frame portion m2 is fixed to an endless belt m5 such as a chain for example which is entrained on sprockets m4 and m4', the sprockets m4 and m4' being rotatably mounted at a predetermined spacing on one vertical wall m3' of a generally ⊐-shaped moving member m3. A slide member m6 is fixed to the moving member m3 so as to be fitted in a fixed guide rail m7 disposed on the frame m1 side. The slide member m6 fixed to the moving member m3 is constructed so as to move horizontally along the fixed guide rail m7. Therefore, the moving member m3 with the slide member m6 fixed thereto is also constructed for horizontal movement along the guide rail m7.

A lower frame portion m8 is fixed to the lower portion of the endless belt m5, and a can resting member m9 for resting the empty cans E1, E2 or full-loaded cans F1', F2' thereon is fixed to the lower frame portion m8. Also on the side of a frame m1' opposed to the frame m1 there are mounted sprockets m10, m10', endless belt m11, fixed guide rail m12, etc. which are similar to the sprockets m4, m4', endless belt m5, slide member m6 and fixed guide rail m7 disposed on the frame m1 and the vertical wall m3' of the ⊐-shaped moving member m3.

Further, m13 denotes a motor for rotating forward and reverse one sprocket m10 of sprockets m10 and m10', and m14 denotes a shaft for connecting the two sprockets m4 and m10 which are mounted rotatably to vertical walls m3' and m3" of the generally ⊐-shaped moving member m3.

Figure 4:
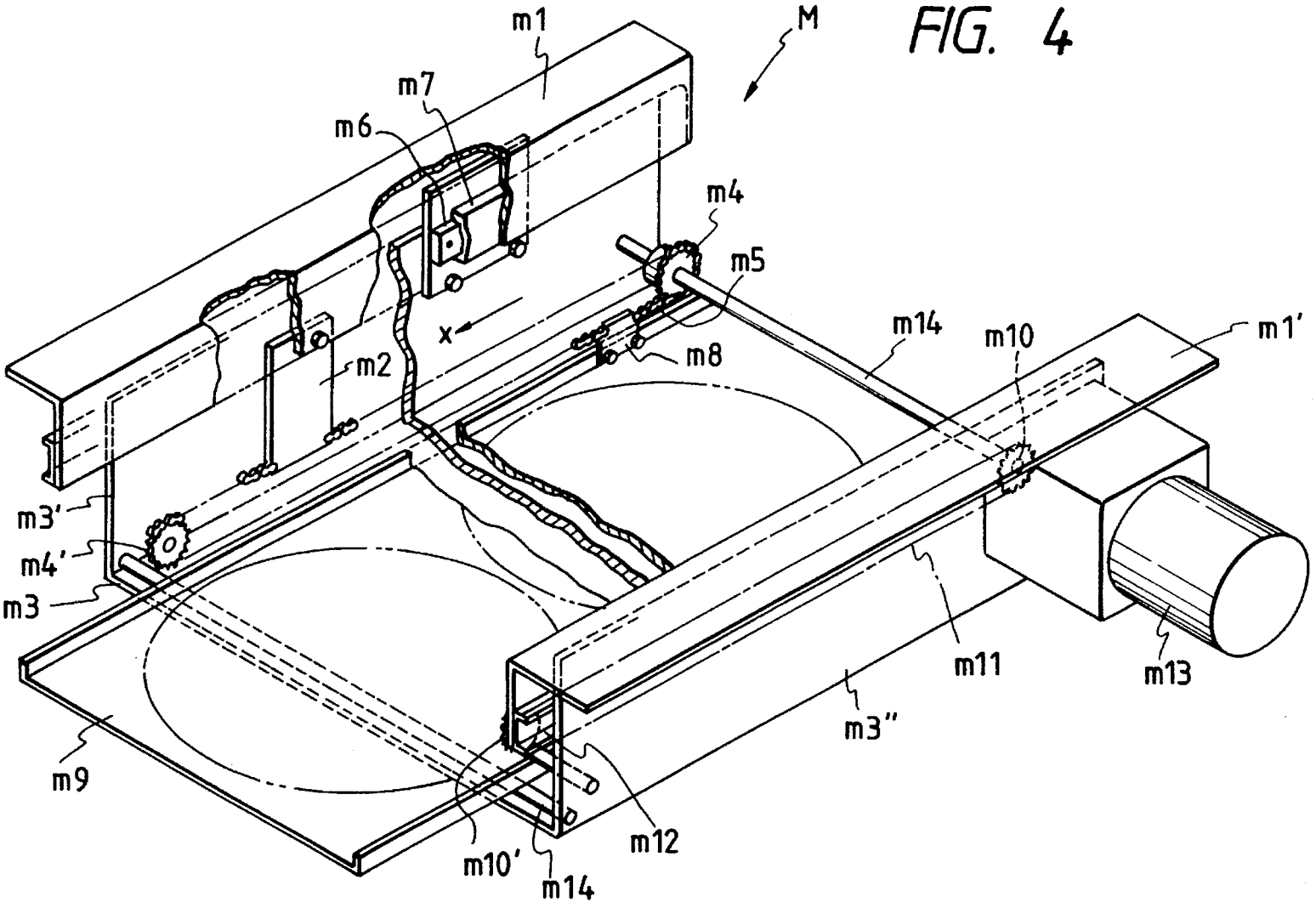
FIG. 4 is a perspective view of a can transfer device on the cans exchanging carrier.

When the motor m13 is rotated, thereby causing the sprockets m4 and m10 to rotate in the clockwise direction in FIG. 4, the generally ⊐-shaped moving member m3 to which are mounted the sprockets m4 and m4' with the endless belt m5 entrained thereon moves in the direction of x, namely, toward the spinning frame S, because the upper frame portion m2 is fixed to the frame m1.

On the other hand, since the lower portion of the endless belt m5 moves in the arrow x direction, namely, toward the spinning frame S, the lower frame portion m8 attached to the lower portion of the endless belt and hence the can resting member m9 fixed to the lower frame portion also move toward the spinning frame S.

In the above construction, upon clockwise rotation of the sprockets m4 and m10 in FIG. 4, the moving member m3 advances toward the spinning frame S and at the same time the can resting member m9 also advances in the same direction. Thus, since the moving member m3 and the can resting member m9 advance telescopically toward the spinning frame, the can resting member m9 can move a distance approximately twice as long as that moving distance of the endless belt m5 and hence it is possible to construct the cans exchanging carrier V in a compact form.

Conversely, when the sprockets m4 and m10 are rotated counterclockwise in FIG. 4, the moving member m3 and the can resting member m9 move away from the spinning frame S also telescopically and are accommodated in the cans exchanging carrier V. Numeral m14 denotes a support rod which is for decreasing the friction of the can resting member m9 held between the vertical walls m3' and m3" of the moving member m3 and which may be disposed suitably as necessary.

Two sets of the can transfer devices M described above are mounted side by side on the cans exchanging carrier V, one of which is for carrying two full-loaded cans F1' and F2' thereon, while the other is for carrying empty cans E1 and E2 thereon.

Figure 5:
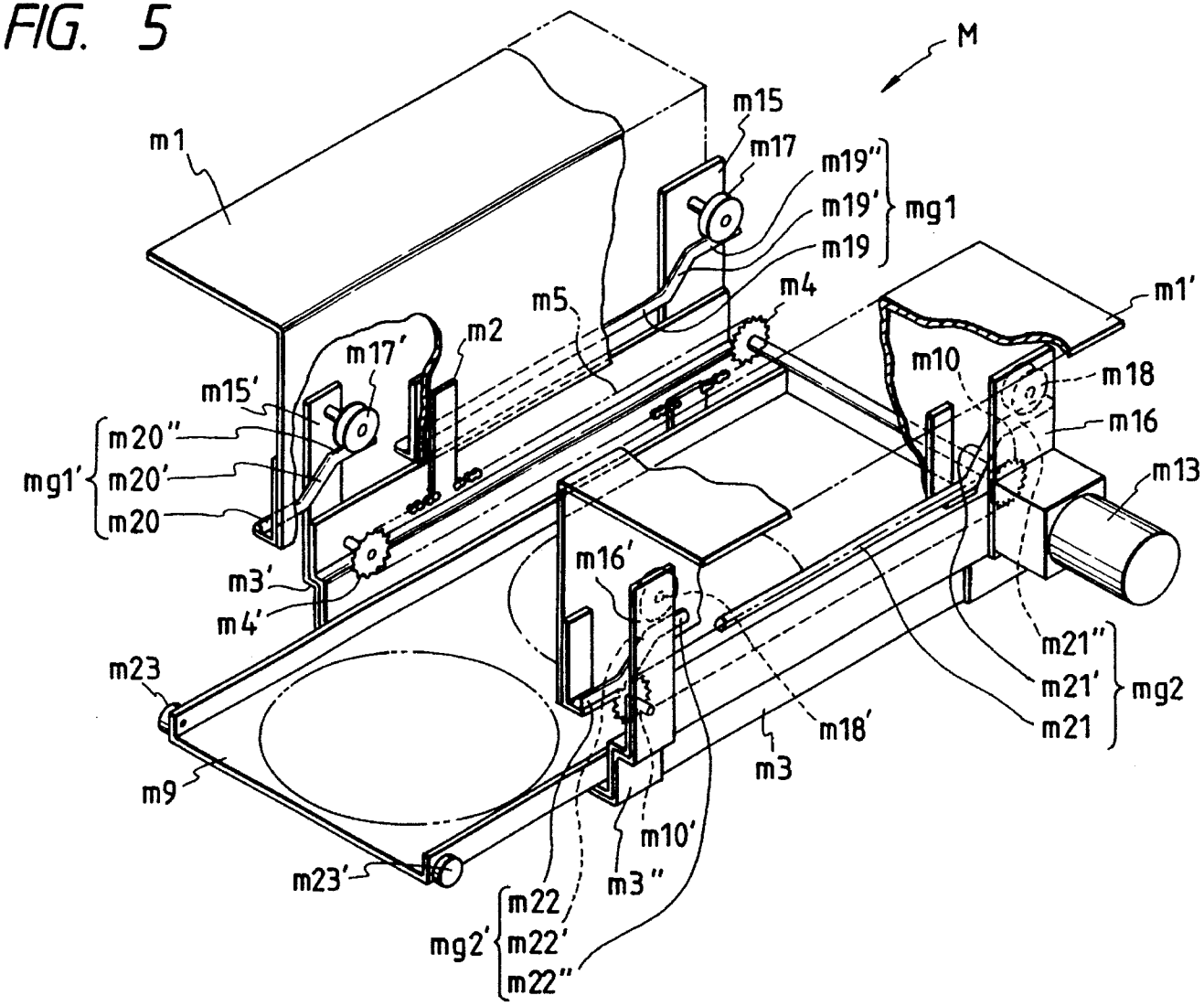
FIG. 5 is a perspective view showing another example of a can transfer device on the cans exchanging carrier.

FIG. 5 is a perspective view showing another example of a can transfer device M, in which the same portions as in FIG. 4 are indicated by the same reference numerals as in FIG. 4.

The can transfer device M illustrated in FIG. 5 has about the same construction as that of the can transfer device M shown in FIG. 4 except that the two are different mainly in point of guide means for the moving member m3 with respect to the frames m1 and m1'. This different point will mainly be explained in the following description.

Numerals m15, m15' and m16, m16' denote vertical frames attached to both end portions or thereabouts of the vertical walls m3' and m3", respectively, of the moving member m3. To the vertical frames m15, m15', m16 and m16' are mounted drum rollers m17, m17', m18 and m18', respectively. The frame ml of the cans exchanging carrier V is secured a guide rail mg1 in a position corresponding to a rear portion of the carrier V (the side confronting the cans F arranged in the spinning frame S and the opposite side will hereinafter be referred to as "front portion" and "rear portion", respectively), the guide rail mg1 comprising a horizontal part m19, an inclined part m19' which is inclined upward with respect to the horizontal part m19, and a horizontal part m19", with the drum roller m17 being rested thereon which roller is mounted rotatably to the vertical frame m15. Likewise, a guide rail mg1' comprising a horizontal part m20, an inclined part m20' inclined upward with respect to the horizontal part m20 and a horizontal part m20" is secured to the frame ml of the cans exchanging carrier V in a position corresponding to the front portion of the carrier, with the drum roller m17' being rested thereon which roller is mounted rotatably to the vertical frame m15'. Further, a guide rail mg2 comprising a horizontal part m21, an inclined part m21' inclined upward with respect to the horizontal part m21 and a horizontal part m21" is secured to the frame m1' of the cans exchanging carrier V in a position corresponding to the rear portion of the carrier, with the drum roller m18 being rested thereon which roller is mounted rotatably to the vertical frame m16. Likewise, a guide rail mg2' comprising a horizontal part m22, an inclined part 22' inclined upward with respect to the horizontal part m22 and a horizontal part m22" is secured to the frame m1' of the cans exchanging carrier V in a position corresponding to the front portion of the carrier, with the drum roller m18' being rested thereon which roller is mounted rotatably to the vertical frame m16'. The horizontal part m20 and horizontal part m22 on the carrier front portion side of the guide rails mg1' and mg2', respectively, which are secured to the carrier frames m1 and m1' on the front portion side of the carrier V are formed lower with respect to the floor than the horizontal part m19 and horizontal part m21 on the carrier rear portion side of the guide rails mg1 and mg2, respectively. The horizontal part m19 and horizontal part m21 of the guide rails mg1 and mg2, respectively, are formed longer than the horizontal part m20 and horizontal part m22 of the guide rails mg1' and mg2', respectively. The guide rails mg1 and mg2 are of the same construction, while the guide rails mg1' and mg2' are of the same construction. Numerals m23 and m23' denote wheels mounted to the can resting member m9 in front lower positions.

In the above construction, when the motor m13 is rotated, thereby causing the sprocket m10 to rotate clockwise in FIG. 5, the generally ⊐-shaped moving member m3 to which are mounted sprockets m4 and m4' with endless belt m5 entrained thereon moves toward the spinning frame S because the upper frame portion m2 is fixed to the frame m1. At this time, since the drum rollers m17, m17', m18 and m18' attached to the generally ⊐-shaped moving member m3 are rested on the guide rails mg1, mg1', mg2 and mg2' having the foregoing constructions, they move while retaining their horizontal posture in the initial stage of the movement of the moving member m3 toward the spinning frame S, then move down along the inclined parts m19', m20', m21' and m22' of the guide rails mg1, mg1', mg2 and mg2', so that the moving member 3 moves down and consequently the can resting member m9 comes closer to the floor. In this case, since the horizontal part m20 and horizontal part m22 of the guide rails mg1' and mg2' are shorter than the horizontal part m19 and horizontal part m21 of the guide rails mg1 and mg2, the drum rollers m17' and m18' attached to the generally ⊐-shaped moving member m3 are disengaged from the guide rails mg1' and mg2' and the wheels m23 and m23' mounted to the can resting member m9 in front lower positions come into direct contact with the floor, resulting in that the can resting member m9 comes closer to the floor and is sure to be inserted between empty cans E1, E2 and the floor. Also in the case of resting the full-loaded cans F1' and F2' on the floor, those full-loaded cans are placed on the floor accurately and surely because the difference in height between the can resting member m9 and the floor is small. The drum rollers m17 and m18 are never disengaged from the guide rails mg1 and mg2 because the horizontal part m19 and horizontal part m21 of the guide rails mg1 and mg2 are formed long.

Also when the can resting member m9 is retreated, since the horizontal part m20 and horizontal part m22 of the guide rails mg1' and mg2' secured to the frames m1 and m1' of the cans exchanging carrier V in positions corresponding to the front portion of the carrier are formed low so as to come closer to the floor, the drum rollers m17' and m18' of the generally ⊐-shaped moving member m3 which have been disengaged from the guide rails mg1' and mg2' first come into abutment with the inclined parts m20' and m22' of the guide rails mg1' and mg2', whereby the drum rollers m17' and m18' can surely be rested on the guide rails mg1' and mg2'.

Figure 6:
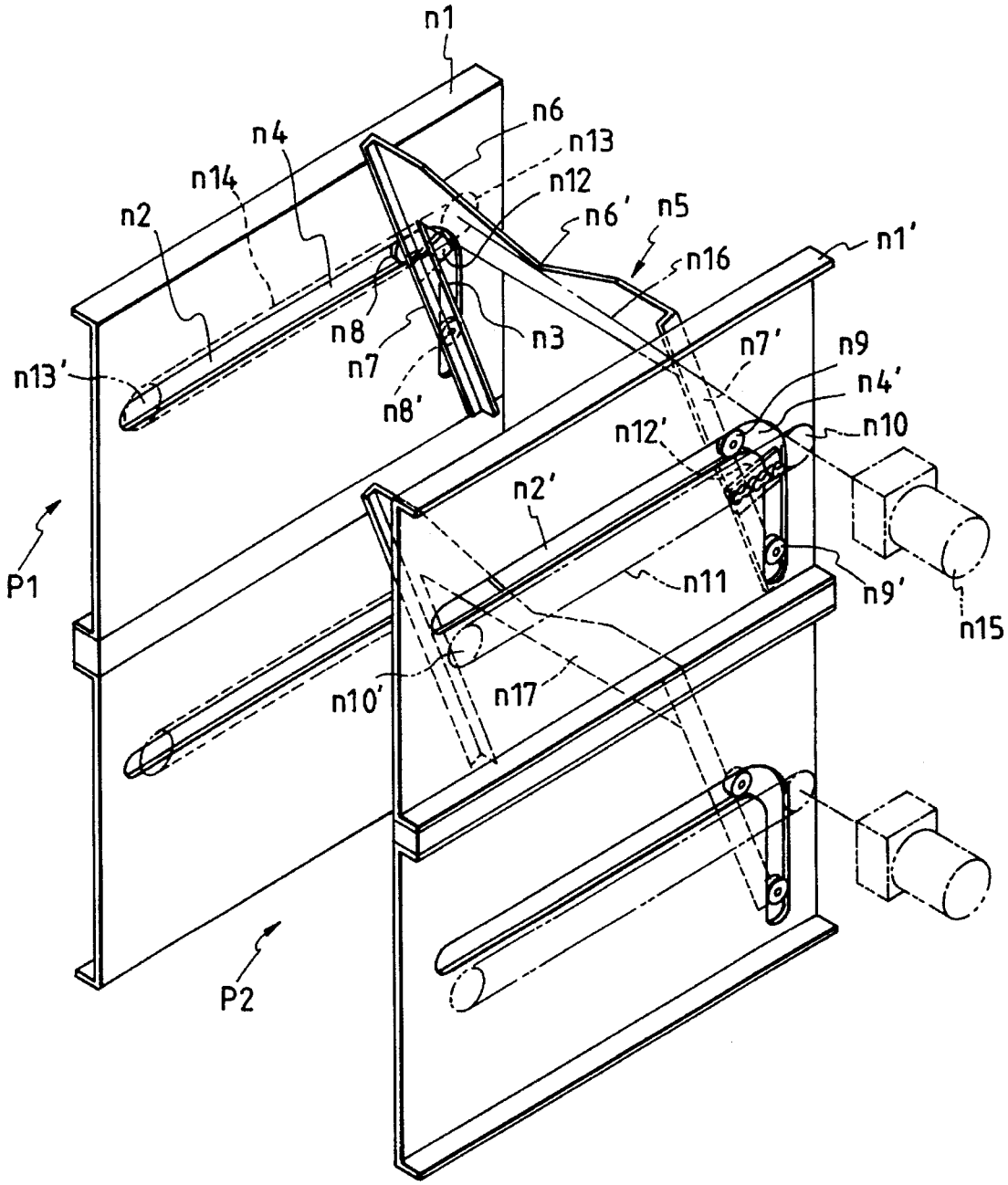
FIG. 6 is a perspective view of upper and lower presser members on the cans exchanging carrier.

Now, with reference to FIG. 6, the following description is provided about the upper presser member p1 and lower presser member p2. Since both presser members p1 and p2 are of the same construction, only the upper presser member p1 will be explained below.

Numerals n1 and n1' denote frames of the cans exchanging carrier V. In the frames n1 and n1' there are formed generally L-shaped guide slots n4 and n4', respectively, comprising generally horizontal slots n2, n2' extending from the front to the rear portion of the carrier V and generally vertical slots n3, n3' contiguous to the horizontal slots n2, n2' on the rear portion side of the carrier.

Numeral n5 denotes a generally M-shaped, upper can presser plate comprising a front plate n6, the front plate n6 having a recess n6' which comes into contact with a can, and side plates n7, n7' extending from both ends of the front plate n6 in an approximately perpendicular direction. Near both end portions of the side plates n7 and n7' of the generally L-shaped guide slots n4 and n4' there are mounted guide rollers n8, n8' and n9, n9' at a predetermined spacing which are fitted in the generally L-shaped guide slots n4 and n4', respectively.

Numerals n10 and n10' denote sprockets which are mounted rotatably to the frame n1'. An endless belt n11 comprising a chain or the like is stretched between the sprockets n10 and n10' along the generally horizontal slot n2' of the generally L-shaped guide slot n4' and over the width of the slot n2'. One end of a mounting plate n12' is pivotally secured to the endless nelt n11 and the opposite end thereof is pivotally secured to the side plate n7' of the generally M-shaped upper can presser plate n7'. Also on the frame n1 side there are mounted a mounting plate n12, sprockets n13, n13' and endless belt n14 in the same manner as above. Numeral n15 denotes a motor for rotating forward and reverse the sprocket n10 attached to the frame n1'. Numeral n16 indicated by a dot-dash line denotes a shaft for transmitting the rotation of the sprocket n10 to the sprocket n13. Further, numeral n17 denotes a lower can presser plate having the same construction as that of the upper can presser plate n5. Since the operation mechanism of the lower can presser plate n17 is the same as that of the upper can presser plate n5, an explanation thereof is here omitted.

In the construction described above, when the motor n15 is driven to rotate the sprocket n10 and n13 in the clockwise direction from a stand-by position corresponding to a substantially vertical state of the generally M-shaped, upper can presser plate n5, as shown in FIG. 6, the mounting plates n12 and n12' which are pivotally secured at one ends to the endless belts nil and n14 move toward the front portion of the cans exchanging carrier V, namely, toward the spinning frame S. With this movement, the guide rollers n8' and n9' move upward along the vertical slots n3 and n3' formed in the side plates n7 and n7' of the generally M-shaped, upper can presser plate n5 to which are pivotally secured the opposite ends of the mounting plates n12 and n12', while the guide rollers n8 and n9 move horizontally along the horizontal slots n2 and n2', so that the upper can presser plate n5 which is in its substantially vertical stand-by position moves toward the spinning frame S while tilting in the horizontal direction.

Conversely, when the motor n15 is rotated reverse to turn the sprockets n10 and n13 in the counterclockwise direction from the advanced state toward the spinning frame S and horizontally positioned state of the generally M-shaped, upper can presser plate n5, the mounting plates n12 and n12' move toward the rear portion of the cans exchanging carrier V, so that the upper can presser plate n5 also retreats and the guide rollers n8' and n9' are guided by the generally vertical slots n3 and n3' of the generally L-shaped guide slots n4 and n4', respectively. As a result, the upper can presser plate n5 moves back while tilting from its horizontal state toward its stand-by position corresponding to a substantially vertical position.

Explanation of the lower presser member p2 is here omitted because it has the same construction as that of the upper presser member p1 and operates in the same manner as p1, as mentioned above.

It is preferable that the upper and lower presser members p1, p2 be arranged side by side on the cans exchanging carrier V in correspondence to the can transfer device M. However, only the upper presser member p1 may be disposed on the side where empty cans E1 and E2 are accommodated, while only the lower presser member p2 may be disposed on the side where full-loaded cans F1' and F2' are located. In the case where the set of the upper and lower presser member p1, p2 are arranged side by side on the cans exchanging carrier V correspondingly to the can transfer device M, it is optional in which position on the carrier V the full-loaded cans F1' and F2' are to be placed, and either the upper presser member p1 or the lower presser member p2, which is required, is operated according to the position of the full-loaded cans F1', F2' and in accordance with a command provided from a suitable controller.

For accommodating the empty cans E1 and E2 onto the cans exchanging carrier V, as already explained with reference to FIGS. 2A to 2E, the motor n15 is rotated to turn the sprockets n10 and n13 to turn clockwise, and the generally M-shaped, upper can presser plate n5 which is in its stand-by position corresponding to a substantially vertical state is advanced toward the spinning frame S while being tilted in the horizontal direction to push the upper portion of the empty can E2, thereby causing the empty cans E1 and E2 to be tilted at a time as in FIG. 2B. Then, the sprockets m4 and m10 are turned clockwise in FIG. 4 by means of the motor m13, causing the moving member m3 and the can resting member m9 to advance the spinning frame S in a telescopic manner until the can resting member m9 is inserted between the tilted empty cans E1, E2 and the floor. Thereafter, the sprockets n10 and n13 are turned counterclockwise, thereby causing the upper can presser plate n5 to move back from its horizontal state toward its stand-by position corresponding to a substantially vertical state. Next, the sprockets m4 and m10 are turned counterclockwise in FIG. 4, thereby causing the can resting member m9 with empty cans E1 and E2 rested thereon to move away from the spinning frame S telescopically in the same manner as above to accommodate the empty cans E1 and E2 onto the cans exchanging carrier V.

For carrying in the full-loaded cans F1' and F2' on the carrier V to the carried-out position of the empty cans E1 and E2, as explained previously with reference to FIGS. 2A to 2E, the can resting member m9 with the full-loaded cans F1' and F2' rested thereon is moved toward the spinning frame S telescopically in the same way as above, allowing F1' and F2' to be carried into the carried-out position of E1 and E2. Then, like the upper presser member p1, the lower presser member p2 is moved toward the spinning frame S until abutment with a nearly middle part of the full-loaded can F2'. Thereafter, the can resting member m9 is moved back while the nearly middle part of F2' is held by the lower presser member p2. In this case, since the full-loaded can F2' is held by the lower presser member p2, only the can resting member m9 retreats, whereby the full-loaded cans F1' and F2' are carried into the predetermined position.

Next, a sliver engaging device used in the present invention will be described below with reference to FIG. 7 which is a perspective view showing an arrangement relation of cans c1, c1' , c1", c2, c2', c2", sliver guides g1 to g6 and a sliver guide shaft A in the present invention and FIG. 8 which is a perspective view showing a like arrangement relation in the prior art.

Figure 8:
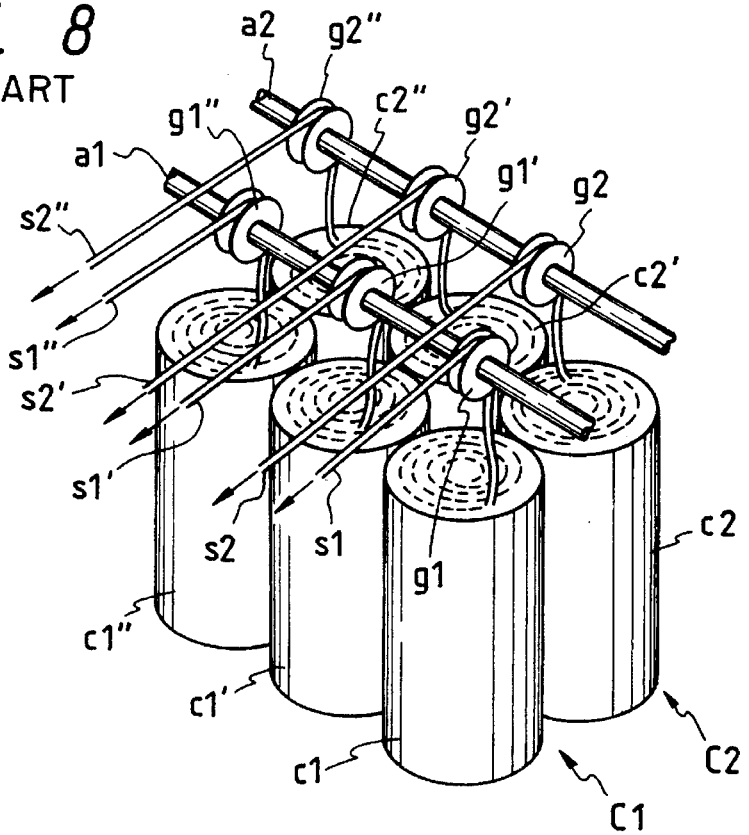
FIG. 8 PRIOR ART
FIG. 8 is a perspective view showing an arrangement relation of sliver guides and sliver guide shafts in the prior art.

According to the prior art, as shown in FIG. 8, sliver guide shafts a1 and a2 are disposed respectively above substantially central portions of cans c1, c1', c1" of row C1 and above substantially central portions of cans c2, c2', c2" of row C2. On the sliver guide shaft a1 are mounted sliver guides g1, g1', g1", while mounted on the sliver guide shaft a2 are sliver guides g2, g2', g2". For example, sliver s1 drawn out from can c1 is fed while being passed onto the sliver guide g1, while sliver s2 drawn out from can c2 is fed while being passed onto the sliver guide g2. Likewise, sliver s1' drawn out from can c1' is fed while being passed onto the sliver guide g1', sliver s2' drawn out from can c2' is fed while being passed onto the sliver guide g2', sliver s1" drawn out from can c1" is fed while being passed onto the sliver guide g1", and sliver s2" drawn out from can c2" is fed while being passed onto the sliver guide g2". In the conventional sliver engaging device thus constructed, if cans c1 and c2 are carried out simultaneously for example, there will occur a trouble such as abutment of slivers s1, s1' and s1" positioned on the spinning frame S side against sliver guides g2, g2' and g2" and the resulting breakage thereof.

Figure 7:
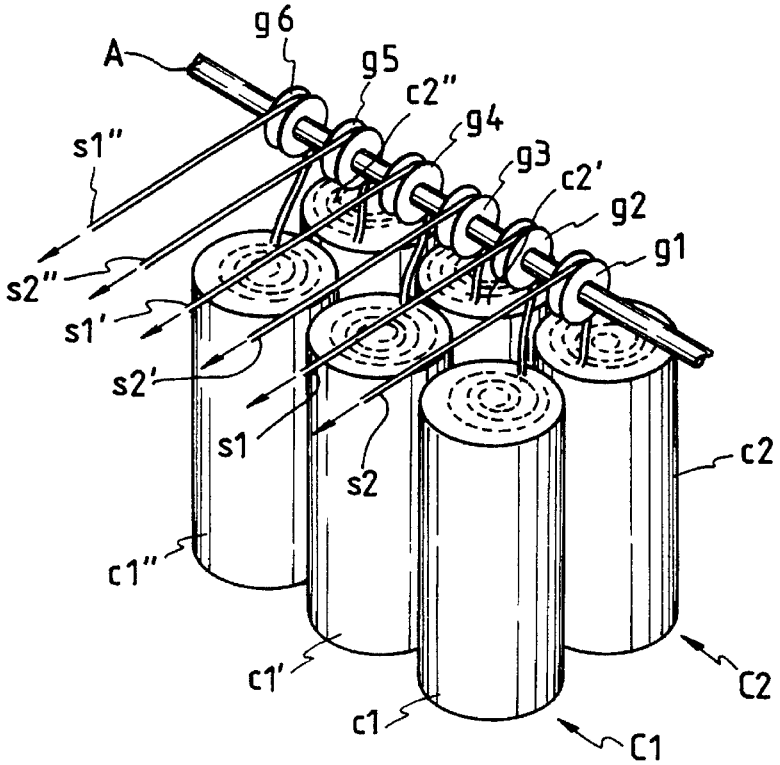
FIG. 7 is a perspective view showing an arrangement relation of sliver guides and a sliver guide shaft in the present invention.

In the sliver engaging device according to the present invention, as shown in FIG. 7, a single sliver shaft A is disposed above a substantially middle portion between the row C1 of cans c1, c1', c1" and the row C2 of cans c2, c2', c2", and on the shaft A there are mounted sliver guide g1 for sliver s1 drawn out from can c1, sliver guide g2 for sliver s2 drawn out from can c2, sliver guide g3 for sliver s1' drawn out from can c1', sliver guide g4 for sliver s2' drawn out from can c2', sliver guide g5 for sliver s1" drawn out from can c1" and sliver guide g6 for sliver s2 drawn out from can c2". In this construction, even if cans c1 and c2 are carried out simultaneously for example, there is no fear of the sliver s1 on the spinning frame S side coming into abutment against the sliver guide A, and therefore it is possible to prevent such a trouble as breaking of the sliver s1.

The following description is now provided about functions and effects of the above embodiment of the present invention.

In a spinning machine wherein the spacing between cans is narrow and cans are arranged in plural rows in the longitudinal direction of the spinning machine, empty cans can be replaced with full-loaded cans simultaneously, efficiently and that rapidly.

Since empty cans in the same spinning machine can be carried out from the rows of cans using a space required for only tilting of the empty cans, there is needed only a small space for the replacement of empty cans with full-loaded cans, thus permitting arrangement of a larger number of spinning machines. In this way it is possible to attain effective utilization of space.

Since full-loaded cans can be carried into the carried-out position of empty cans by only movement of the cans exchanging carrier in the longitudinal direction of the spinning machine, it is possible to diminish the spacing between spinning machines, thus permitting arrangement of a larger number of spinning machines. In this way there is attained effective utilization of space.

Since the can transfer device disposed on the cans exchanging carrier is moved forward and backward telescopically with respect to the spinning machine, it is possible to construct the can exchanging carrier in a compact form. Consequently, the spacing between spinning machines can be made smaller, thus permitting effective utilization of space such as the arrangement of a larger number of spinning machines.

Since the can transfer device on the cans exchanging carrier is advanced and retreated telescopically and the can resting member of the can transfer device is brought closer to the floor, it is possible to effect carrying-out of empty cans and carrying-in of full-loaded cans surely and that accurately.

Since the presser members for tilting or pressing cans are advanced or retreated with respect to the spinning machine while being guided and tilted along generally L-shaped guide slots, only a short horizontal moving distance of the presser members is needed, thus permitting a compact construction of the cans exchanging carrier. Consequently, the spacing between spinning machines can be made smaller, so there can be attained effective utilization of space such as arrangement of a larger number of spinning machines.

A single sliver guide shaft is disposed for plural rows of cans, so at the time of carrying-out of empty cans, there is no fear of abutment of slivers from spinning frame-side cans against sliver guides and therefore it is possible to prevent the occurrence of trouble such as breaking of the said slivers.

Since the present invention is constructed as above, the following effect can be attained.

In a spinning machine wherein the spacing between cans is narrow and cans are arranged in plural rows in the longitudinal direction of the spinning machine, empty cans can be replaced with full-loaded cans simultaneously, efficiently and that quickly.

Another embodiment of the present invention will be described below with reference to FIGS. 9 to 17, provided that no limitation is made thereto as long as the gist of the invention is observed.

Various devices, etc. which constitute a cans exchanging carrier V will be described below with reference to FIG. 9 which is a schematic perspective view of the carrier V.

A pair of can transfer devices M1 and M2 are disposed on a floor frame v1 of the cans exchanging carrier V. In connection with the work of changing empty cans E1, E2 for full-loaded cans F1', F2', the full-loaded cans F1', F2' are rested on the can transfer device M1, while the empty cans E1, E2 are on the can transfer device M2.

An urging device P for actuating an urging member p is mounted to side frames v2, v3 and central frame v4 which are erected on the floor frame v1 approximately perpendicularly to the traveling direction of the cans exchanging carrier V. Urging devices P1 and P2 on the can transfer device M1 side are mounted to one side frame v2 and central frame v4, while urging devices P3 and P4 on the can transfer device M2 side are mounted to the other side frame v3 and central frame v4.

Urging members p1 and p2 of the urging devices P1 and P2, respectively, are for urging a can in cooperation with each other and are therefore constructed so as to move in a synchronized manner. Likewise, urging members p3 and p4 of the urging devices P3 and P4, respectively, are for urging a can in cooperation with each other and are therefore constructed for synchronized movement.

The synchronizing means for the urging members p1, p2 and that for the urging means p3, p4 are the same, so the former will be described below with reference to FIG. 9.

Figure 9:
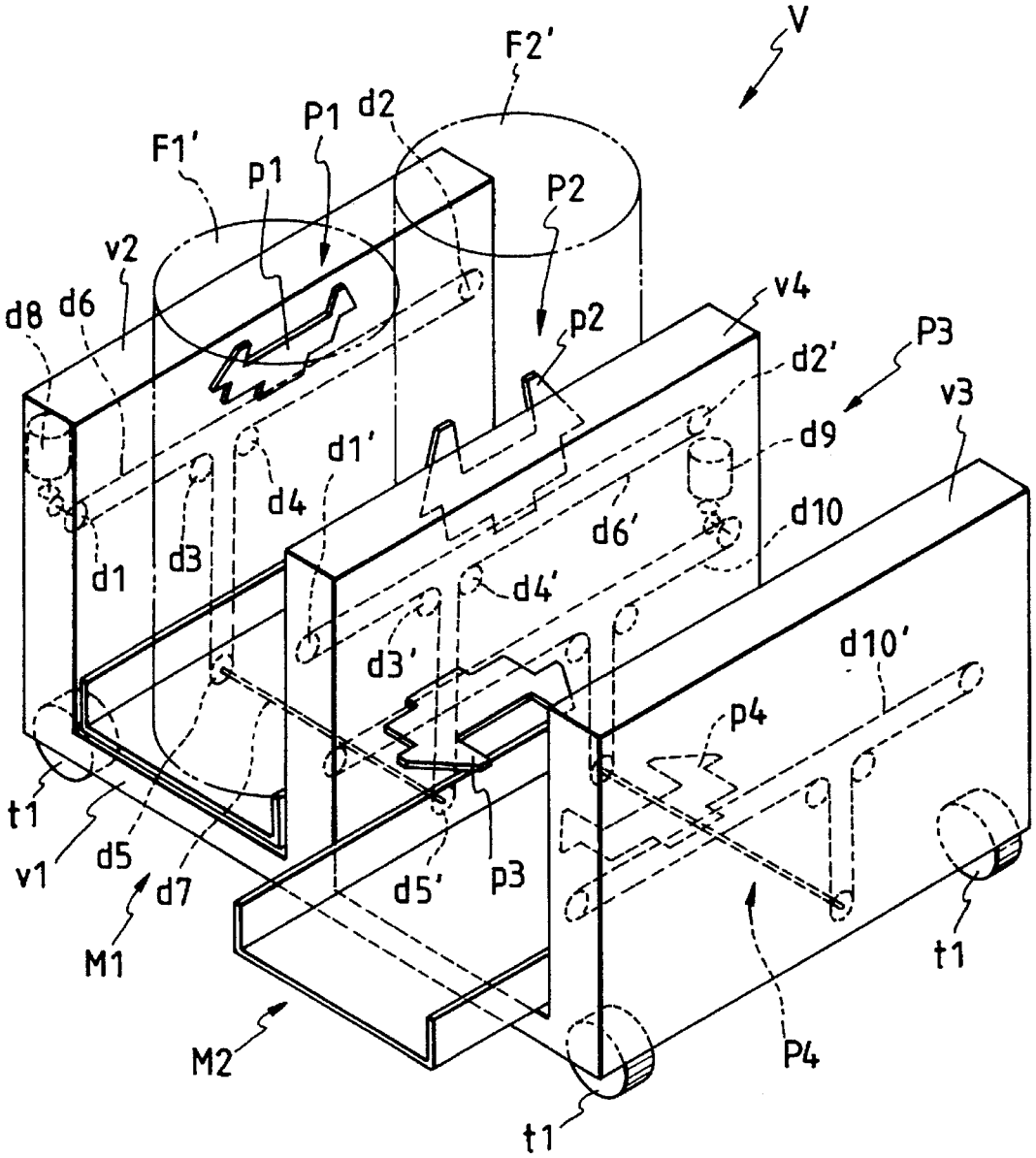
FIG. 9 is a schematic perspective view of the cans exchanging carrier.

In FIG. 9, t1 denotes a wheel of the cans exchanging carrier V. The carrier V can be constructed for self-traveling or for traction using a suitable tractor.

Numerals d1 and d2 denote pulleys disposed at an approximately medium height of the side frame v2 and at both ends in the transverse direction of the carrier V. Numerals d3 and d4 denote guide rollers for guiding an endless belt d6 in a generally T shape toward a pulley d5 disposed nearly centrally of the lower portion of the side frame v2. To the endless belt d6 is attached the urging member p1 by such a means as will be described later.

To the central frame v4 are mounted endless belt d6', pulleys d1', d2', d5' and guide rollers d3', d4' in a mirror-image relation to the arrangement of endless belt d6, pulleys d1, d2, d5 and guide rollers d3, d4 which are mounted to the side frame v2. The urging member p2 is attached to the endless belt d6' by such a means as will be described later.

The pulley d5 disposed nearly centrally of the lower portion of the side frame v2 and the pulley d5' disposed nearly centrally of the lower portion of the central frame v4 are interconnected through a common shaft d7.

Numeral d8 denotes a motor capable of rotating forward and reverse and mounted in a suitable position of the side frame v2. The motor d8 is constructed to drive the pulley d1 mounted to the side frame v2, through a known transmission means such as a gear train or a belt.

By driving the motor d8 capable of rotating forward and reverse, the pulley d1 is rotated and the endless belt d8 is thereby allowed to travel. Further, the rotation of the pulley d5 is transmitted to the pulley d5' through the shaft d7, whereby the endless belt d6' is allowed to travel.

In the above construction, the urging members p1 and p2 can be operated in a synchronized manner by attaching them in a mirror-image relation respectively to the endless belt d6 mounted to the side frame v2 and the endless belt d6' mounted to the central frame v4.

Also to the side frame v3 and central frame v4 there are mounted a motor d9 capable of rotating forward and reverse, endless belts d10, d10' and urging members p3, p4 in the same manner as in the arrangement of the motor d8, endless belts d6, d6' and urging members p1, p2 which are mounted to the side frame v2 and central frame v4, the urging members p3 and p4 being operated in a synchronized manner.

Since two urging devices P2 and P3 are mounted to the central frame v4, it is desirable that the height of the endless belts d6, d6' mounted to the side frame v2 and central frame v4 and that of the endless belts d10, d10' mounted to the side frame v3 and central frame v4 be displaced from each other as in FIG. 9. By so doing it is made possible to prevent the increase in thickness of the central frame v4 and hence prevent the increase in size of the cans exchanging carrier V.

The mounting position of the endless belt d6, d6' and that of the endless belts d10, d10' can be set in such a manner that the height in the horizontal state of the urging members p1, p2 attached to the endless belts d6, d6' and that of the urging members p3, p4 attached to the endless belts d10, d10' permit the urging members to push an upper portion than the vertically middle part of a can to tilt the can. But in the case of providing a stopper s on the floor as mentioned previously, it is also possible to make construction so that the height in the horizontal state of the urging members p3 and p4 is located in a lower position than half of the can's height, for example, approximately one-third height of can.

The following description is now provided about the paired can transfer devices M1 and M2 disposed on the floor frame v1 of the cans exchanging carrier V. Since M1 and M2 are of the same construction, the following description will be directed to one device M1 (hereinafter referred to the "can transfer device M") with reference to FIG. 10 which is a perspective view of the can transfer device M, FIG. 11 which is an enlarged perspective view of a tilting device H for a tilting member and FIG. 12 which is a partially enlarged front view of the can transfer device M.

Numeral k1 denotes a tilting member disposed on the floor frame v1 of the cans exchanging carrier V and having open side ends in the can carrying-in and -out direction. A short horizontal shaft k3 is mounted nearly centrally of a side wall k2 of the tilting member k1 and it is supported by a bearing member k4 disposed on the floor frame v1 of the carrier V.

Likewise, also to the other side wall k2' of the tilting member k1 is mounted a short horizontal shaft supported by a bearing member, though not shown.

The tilting device H for the tilting member k1 will be described below mainly with reference to FIG. 11 which is a perspective view of the tilting device shown in FIG. 10 as seen from a right-hand oblique angle.

Figure 11:
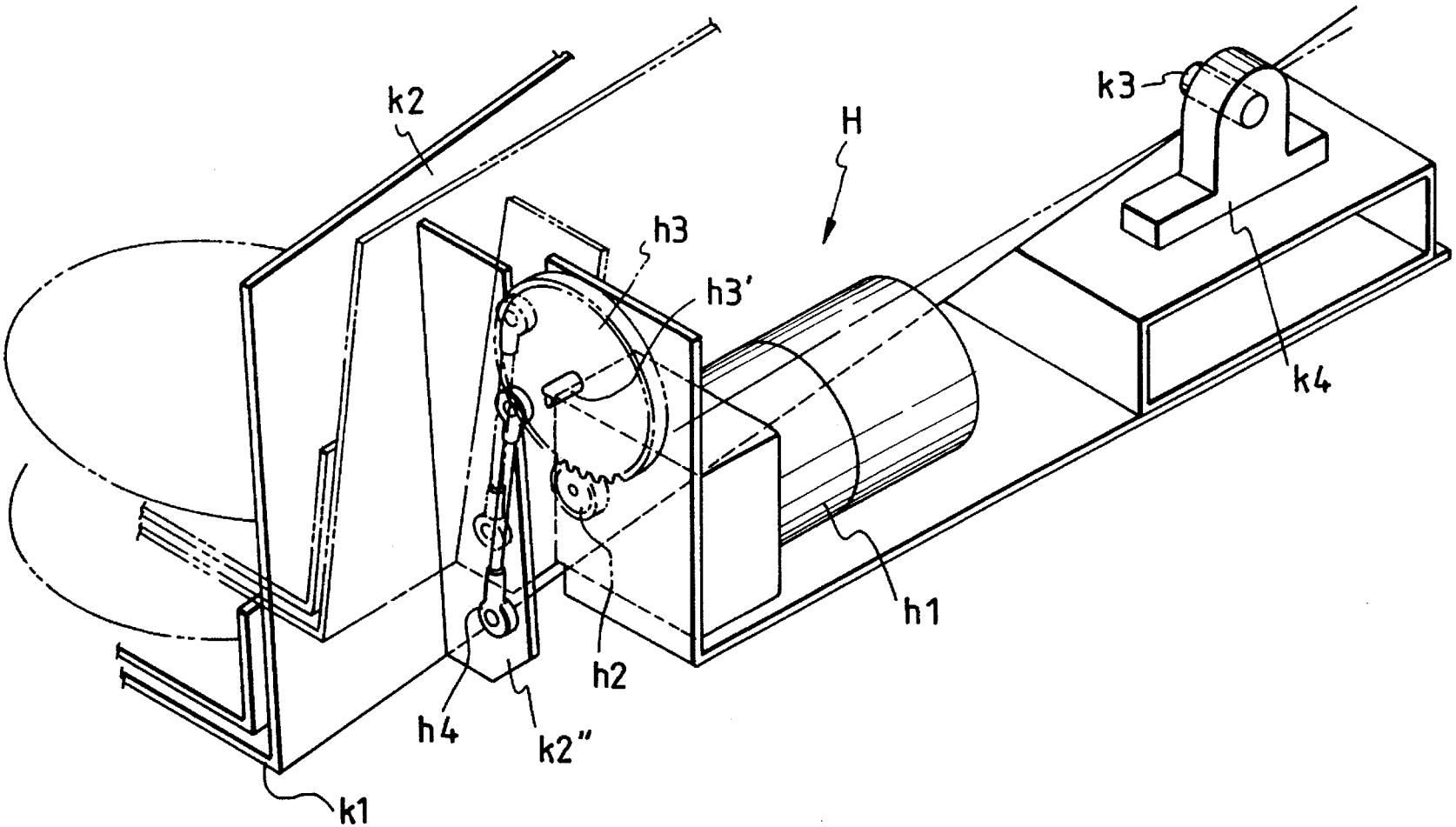
FIG. 11 is an enlarged perspective view of a tilting device for a tilting member.

In FIG. 11, h1 denotes a motor capable of rotating forward and reverse and mounted on the floor frame v1 of the cans exchanging carrier V. A pinion h2 is mounted on an output shaft of the motor h1, and cam spur gear h3 pivotally secured to a horizontal shaft h3' is in mesh with the pinion h2, the horizontal shaft h3' being mounted to a suitable frame (not shown) erected on the floor frame v1.

Numeral k2" denotes a support frame mounted nearly perpendicularly to the side wall k2 of the tilting member k1. One end of a rod h4 is attached to the lower portion of the support frame k2", while the opposite end thereof is connected to the cam spur gear h3 in a suitable off-center position.

The operation of the tilting device H having the above construction will be described below with respect to the case where the tilting member k1 is to be tilted downward on the left-hand side in FIG. 10, that is, from its solid line position to its dash-double dot line position in FIG. 11, as an example.

Usually, the cam spur gear h3 is located in a position in which the tilting member k1 assumes a horizontal state, and the motor h1 capable of rotating forward and reverse is off.

In this state, when the motor h1 is rotated to move the rod h4 upward, the support frame k2" with one end of the rod h4 connected thereto and which is mounted to the side wall k1 of the tilting member k1 moves upward, so that the tilting member k1 tilts about the short horizontal shaft k3 which is mounted to the tilting member and carried on the bearing member k4.

Figure 10:
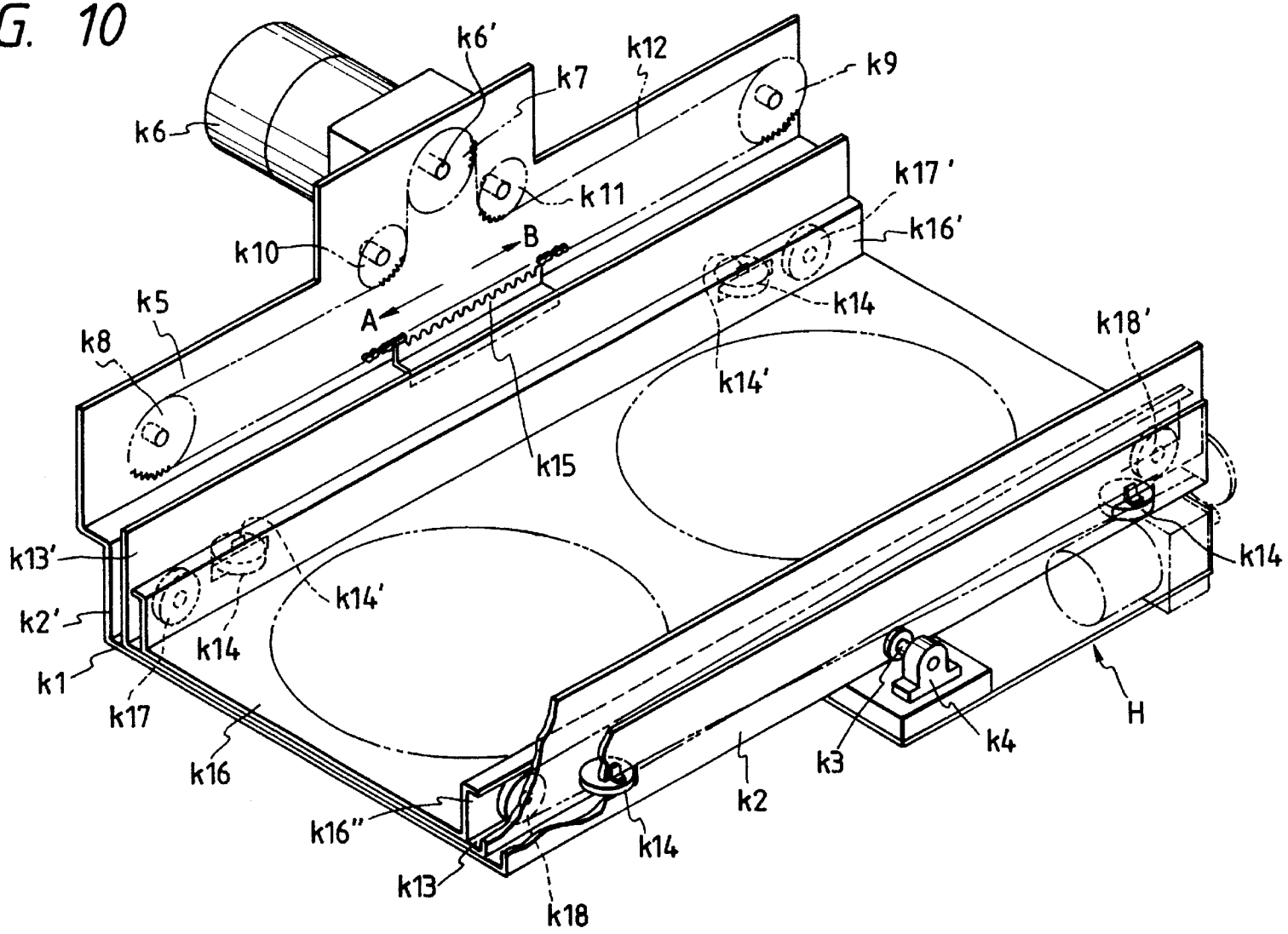
FIG. 10 is a perspective view of a can transfer device.

The tilting member k1 can be tilted downward on the left- or right-hand side in FIG. 10 by suitably controlling the operation of the motor h1.

Such a tilting motion of the tilting member k1 around the short horizontal shaft k3 causes tilting motion of an intermediate moving member k13 and that of a can resting member k16 which are both disposed over the tilting member k1 and which will be described later. Consequently, the can resting member k16 can be advanced and inserted easily between the bottom faces of the tilted empty cans E1, E2 and the can resting member, as shown in FIGS. 2B and 2C.

Likewise, also in the case of taking down the full-loaded cans F1', F2" from the can resting member k16, as shown in FIG. 3C, the difference in height between the can resting member k16 and the floor surface can be diminished because the can resting member is in a tilted state, so that the full-loaded cans F' and F2" can be brought down smoothly from the can resting member k16.

Next, the can transfer device M will be described below mainly with reference to FIGS. 10, 12 and FIG. 13 which illustrates a wire stretching method.

Numeral k5 denotes a supporting side wall formed by extending upward one side wall k2' of the tilting member k1. A motor k6 capable of rotating forward and reverse is mounted to the supporting side wall k5.

Numeral k7 denotes a sprocket mounted on an output shaft k6' of the motor k6 extending through the supporting side wall k5. Sprockets k8 and k9 are mounted to the inner surface of the supporting side wall k5 of the tilting member k1 in positions near both ends of the side wall k5. Further, guide sprockets k10 and k11, though not shown in FIG. 12, are mounted to the inner surfaces of the supporting side wall k5 in positions below the sprocket k7 mounted on the output shaft k6' of the motor k6.

A chain k12 is entrained on the sprocket k7 mounted on the output shaft k6' of the motor k6 and also entrained on the sprockets k8, k9 which are mounted to the inner surface of the supporting side wall k5. The chain k12, which is stretched substantially horizontally by means of the sprockets k8 and k9, is bent by the guide sprockets k10, k11 and then engages the sprocket k7 mounted on the output shaft k6, of the motor k6.

The intermediate moving member k13 is placed on the tilting member k1 through a synthetic resin plate or the like of a low friction secured to the upper surface of the tilting member m1. Like the tilting member k1, the intermediate moving member k13 is also open at both ends in the can carrying-in and -out direction, with substantially vertical side walls k13' and k13" extending on both sides in the direction perpendicular to the can carrying-in and -out direction.

The intermediate moving member k13 is controlled its transverse by horizontal rollers k14 supported pivotably on vertical shafts k14' which are disposed on the side walls k2 and k2' of the tilting member k1 in a suitable number and at a predetermined spacing.

A rack plate k15 having a predetermined length and having upward teeth is erected nearly centrally of the intermediate moving member k13. The rack plate k15 is constructed so as to engage the chain k12 which is stretched substantially horizontally by means of the sprockets k8 and k9 mounted to the inner surface of the supporting side wall k5 of the tilting member k1.

In the above construction, when the motor k6 is driven to rotate the sprocket k7 mounted on the output shaft k6' of the motor, thereby causing the chain k12 stretched substantially horizontally by the sprockets k8 and k9 to travel, the intermediate moving member k13 can be moved through the rack plate k15 which is in engagement with the chain k12.

Thus, since the intermediate moving member k13 is constructed so as to be moved by engagement of the rack plate k15 erected nearly centrally of the side wall k13' of the intermediate moving member with the chain k12, the intermediate moving member k13 can move toward the spinning frame S beyond the sprockets k8 and k9 if only the teeth of the rack plate k15 is partially in engagement with the chain k12, so that the moving distance of the intermediate moving member can be set long. Consequently, not only the can transfer operation can be done positively but also the cans exchanging carrier V can be constructed in a compact form.

The can resting member k16 is disposed on the intermediate moving member k13 through a synthetic resin plate or the like of a low friction which is secured to the upper surface of the intermediate moving member. Like the tilting member k1 and intermediate moving member k13, the can resting member k16 is also open at both ends thereof in the can carrying-in and -out direction, with substantially vertical side walls k16' and k16" extending on both sides in the direction perpendicular to the can carrying-in and -out direction.

Pulleys k17, k17' and pulleys k18, k18' are mounted to the inner surfaces of the side walls k13' and k13", respectively, of the intermediate moving member k13 in both end positions of the side walls, and wires which are retained at their end portions to the tilting member k1 and can resting member k16 are entrained on the pulleys k17, k17' and k18, k18'.

How to stretch the wires will now be described with reference to FIG. 13 which is a side view showing the same method. But since the wire stretching method is common to both sides of the can transfer device M, the following description will be directed to the wire stretching method for wires k19 and k20 entrained on the pulleys k18 and k18' which are mounted to the inner surface of one side wall k13" of the intermediate moving member k13.

As shown in FIG. 13A, the wire k19 is entrained about half of a circumference on one pulley k18 of the intermediate moving member 13. One end of the wire k19 is secured to an end portion x of the tilting member k1 on the side opposite to the side where the pulley k18 of the intermediate moving member is disposed, and the opposite end thereof is secured to an end portion y of the can resting member k16 also on the side opposite to the pulley k18.

The wire k20 is entrained about half of a circumference on the other pulley k18' of the intermediate moving member k13 and one end thereof is secured to an end portion w of the tilting member k1 on the side opposite to the side where the pulley k18' of the intermediate moving member k13 is disposed, and the opposite end thereof is secured to an end portion z of the can resting member k16 on the side opposite to the pulley k18'.

In the above construction, when the motor k6 capable of rotating forward and reverse is driven to rotate the sprocket k7, causing the chain k12 stretched substantially horizontally by the sprockets k8 and k9 to travel, say, in the direction of arrow A in FIG. 12, resulting in that the intermediate moving member k13 also moves in the same direction through the rack plate k15 engaged with the chain k12. With this movement in the arrow A direction of the intermediate moving member k13, the pulley k18 disposed together with the intermediate moving member also moves in the same direction.

Since one end of the wire k19 entrained about half a circumference on the pulley k18 is secured to the end portion x of the tilting member k1 which is mounted to the floor frame v1 of the cans exchanging carrier V and which does not move in the horizontal direction and the opposite end thereof is secured to the end portion y of the can resting member k16 disposed on the intermediate moving member k13 and which is movable, the movement of the pulley k18 in the arrow A direction causes the end portion y of the can resting member k16 to move leftwards in FIG. 13B while being pulled by the wire k19, as shown in the same figure, so that the intermediate moving member k13 and the can resting member k16 located thereon move toward the spinning frame S telescopically, as shown in FIG. 13C.

Likewise, by driving the motor k6 to turn the sprocket k7, thereby causing the chain k12 to travel in the direction of arrow B in FIG. 12, the intermediate moving member k13 is moved in the arrow B direction through the rack plate k15 engaged with the chain k12, resulting in that the pulley k18 disposed at one end of the intermediate moving member also moves in the same direction. With this movement in the arrow B direction of the pulley k18', the end portion z of the can resting member k16 moves rightwards in FIG. 13B while being pulled by the wire k20.

In this way, the intermediate moving member k13 disposed on the tilting member k1 and the can resting member k16 disposed on the intermediate moving member can be advanced toward the spinning frame S on any side in a telescopic manner.

As described above, since the intermediate moving member k13 and the can resting member k16 which constitute the can moving device M can be moved toward any spinning frame S adjacent thereto by rotating the motor k6 appropriately, it is not necessary to consider a carrying-in direction, etc. of the can exchanging carrier with respect to the rows of cans unlike a cans exchanging carrier which performs carrying-in and -out of cans only in one direction. Consequently, not only the efficiency of the cans exchanging work by the cans exchanging carrier V is improved but also the operability of the carrier V is improved.

Figure 14:
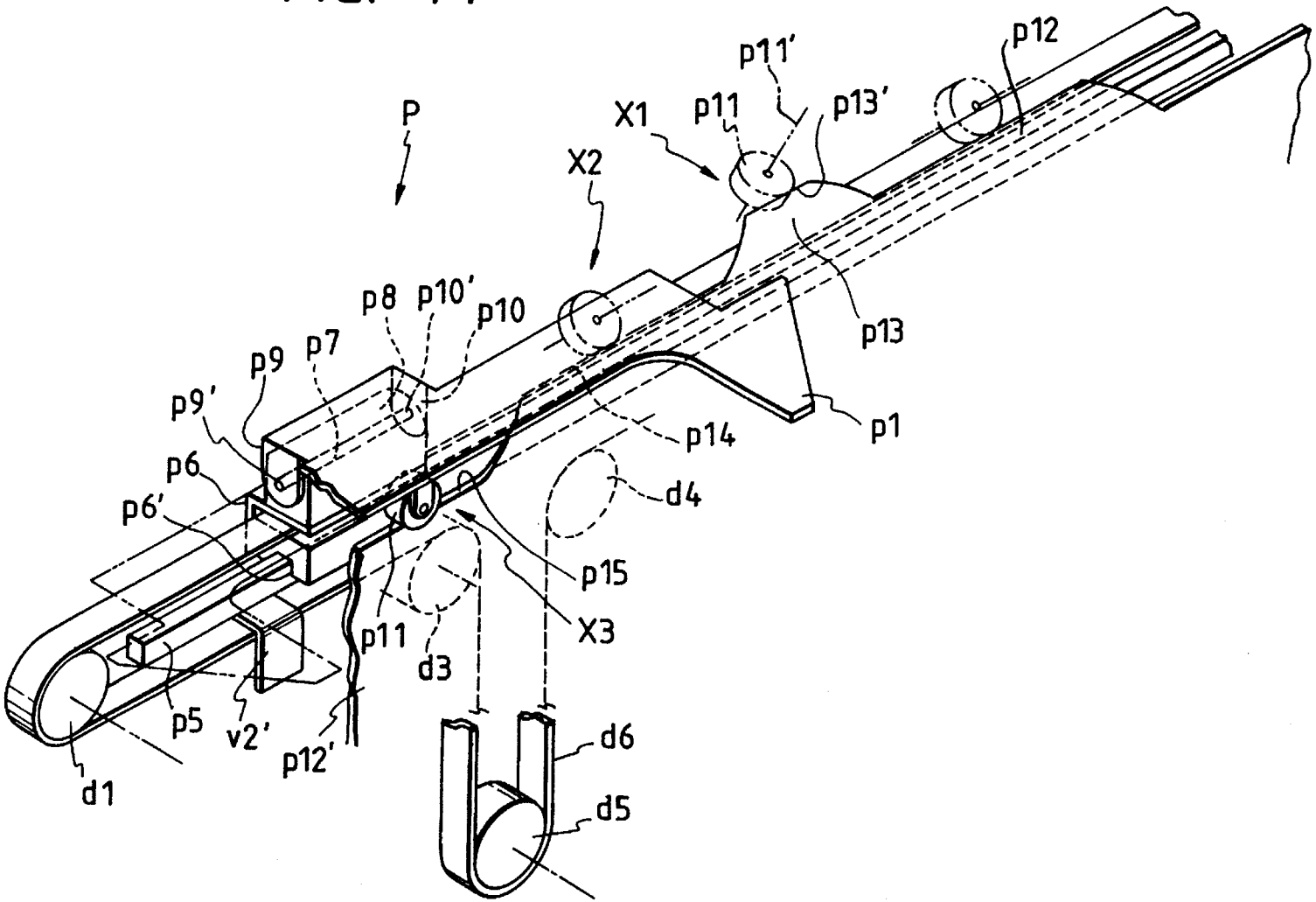
FIG. 14 is an enlarged perspective view of an urging device.

The following description is now provided about the urging device P with reference to FIG. 9 and FIG. 14 which is an enlarged perspective view of the same device.

The urging devices P1, P2, P3 and P4 mounted to the side frames v2, v3 and v4, which have been explained in connection with FIG. 9, are of the same construction, and the tilting means of the paired urging members p1 and p2 disposed in the urging device P1 are the same. In the following description, therefore, only one urging member p1 disposed in the urging device P1 (hereinafter referred to simply as the "urging device P") will be explained.

Numeral p5 denotes a rail secured to a suitable frame v2'. The rail p5 is disposed inside the endless belt d6 and in parallel with the same belt.

A block member p6 is attached to the upper endless belt d6, and a shaft p7 extending in parallel with the traveling direction of the endless belt d6 is mounted to the block member p6.

Further, in the underside of the block member p6 there is formed a channel p6' in the traveling direction of the endless belt d6, with the rail p5 being inserted into the channel p6'.

In this construction, when the motor d8 capable of rotating forward and reverse is driven to rotate the pulley d1, thereby causing the endless belt d6 to travel, the block member p6 attached to the endless belt d6 can be moved along the rail p5.

On the other hand, the urging member p1 has a projecting portion p8 nearly centrally on its side frame v2 side, and tongue pieces p9 and p10 hang from both ends of the projecting portion p8. Through holes p9' and p10' are formed in the tongue pieces p9 and p10, respectively, and the shaft p7 mounted to the block member p6 is fitted therein.

A drum roller p11 is attached to the underside of the urging member p1 in a position near the projecting portion p8, and it comes into abutment with a plate cam p12 mounted to a suitable frame of the side frame v2 which will be described later.

According to this construction, with respect to the block member p6 can turn about the shaft p7 mounted to the same block member and in accordance with a cam surface of the plate cam p12 which will be described below.

The cam plate p12 is formed symmetrically right and left in such a manner that when the urging member p1 is positioned centrally of the side frame v2, it stands nearly vertically as shown on the can transfer device M1 side in FIG. 9, while as the urging member p1 advances toward the spinning frame S, it tilts in the horizontal direction as shown on the can transfer device M2 side in FIG. 9, and when the urging member p1 urges a can, it assumes a completely horizontal state.

As shown in FIG. 14, the cam plate p12 is centrally formed with a chevron-shaped cam surface p13 inclined outwards from a vertical surface p12' of the cam plate and having a generally horizontal top portion, thereby causing the urging member p1 to stand nearly vertically, also has a cam surface p14 contiguous to the chevron-shaped cam surface p13 and inclined closer to the vertical surface p12' side of the cam plate p12 relative to the inclination of the cam surface p13, and further has a cam surface p15 which is substantially vertical like the vertical surface p12' of the cam plate.

The top portion p13' of the chevron-shaped cam surface p13 is the highest, and the cam surfaces p14 and p15 are lower in this order.

The cam surface p14 contiguous to the chevron-shaped cam surface p13 and the substantially vertical cam surface p15 like the vertical surface of the cam plate p12 are disposed symmetrically right and left on both sides of the cam surface p13.

Since the cam plate p12 is formed as above, when the drum roller p11 is positioned on the top portion p13' of the cam surface p13 (the position indicated at X1 in FIG. 14), a rotary shaft p11' of the drum roller faces in a nearly vertical direction, so that the urging member p1 also assumes a generally vertical state.

When the drum roller p11 is positioned on the cam surface p14 (the position indicated at X2 in FIG. 14) which is inclined closer to the vertical surface p12' side of the cam plate p12 relative to the inclination of the cam surface p13, the rotary shaft p11' of the drum roller p11 is shifting in the horizontal direction. and hence the urging member p1 is also tilting in the horizontal direction from its substantially vertical state.

Further, when the drum roller p11 is substantially vertical like the vertical surface p12' of the cam plate p12 and is positioned on the lowest cam surface p15 (the position indicated at X3 in FIG. 14), the rotary shaft p11' of the drum roller p11 faces in a substantially horizontal direction and therefore the urging member p1 also assumes a horizontal state.

Since the cam plate p12 has the above-mentioned shape, the urging member p1 can be allowed to stand nearly vertically so as not to be an obstacle to the cans on the can transfer member when it is positioned centrally of the side frame v2, then can tilt in the horizontal direction as it advances toward the spinning frame S, and when the urging member p1 pushes a can, it can be tilted in a completely horizontal state.

Figure 15:
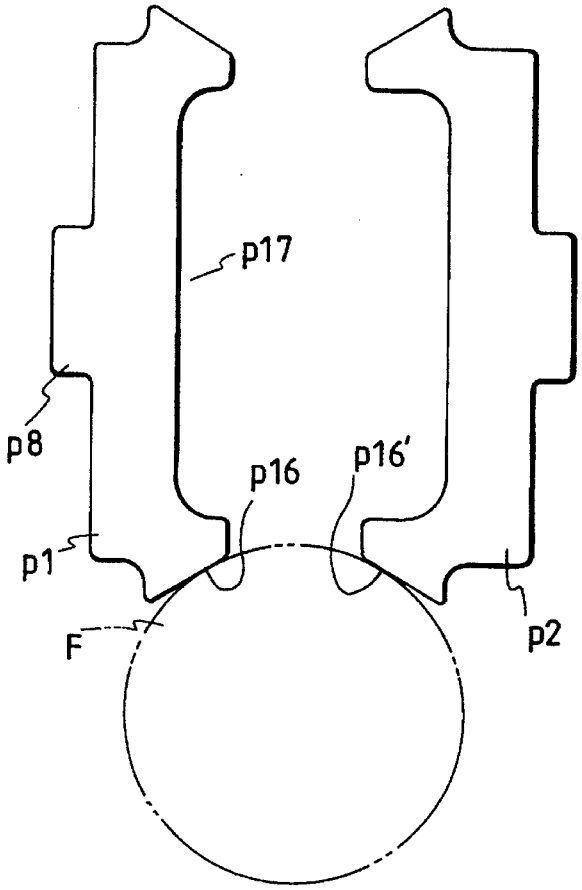
FIG. 15 is a plan view of a pair of urging members.

Reference will be made below to a planar shape of the urging member p1 and that of the urging member p2 with reference to FIG. 15 which is a plan view of both urging members.

Since the urging members p1 and p2 are of the same shape except that they are slightly different in width, the following description will be directed to a planar shape of only one urging member p1.

The urging member p1 is formed by a plate having a generally concave shape wherein a long side extends in the can carrying-in and -out direction. Its short side which comes into abutment with a can has a slant face p16 extending along the outer periphery of the can.

A concave portion extending along the outer peripheral surface of the can is defined by both the slant face p16 of the urging member p1 and a slant face p16' of the other urging member p2, and a portion of the can is brought into abutment with the said concave portion. Consequently, when empty cans E1 and E2 are pushed and tilted as in FIG. 2B, or when the movement of full-loaded cans F1' and F2' in the cans exchanging carrier direction is to be prevented at the time of withdrawing the can transfer device M from under the cans F1' and F2' as in FIG. 3C, there is no fear of the cans from tilting or moving in the longitudinal direction of the spinning frame S.

Figure 16:
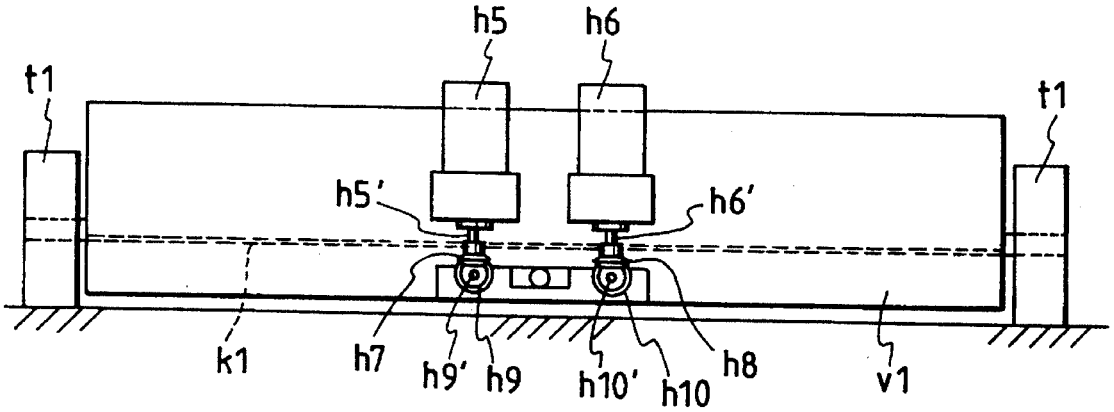
FIG. 16 is a side view of the lower portion of a cans exchanging carrier, showing another example of a tilting device for a tilting member.

Description will be directed below to another example of the tilting device H for the tilting member k1 in the can transfer device M with reference to FIG. 16 which is a side view of the lower portion of the cans exchanging carrier V and FIG. 17 which is a side view showing the operation of the tilting member k1 in the can transfer device M.

Numerals h5 and h6 denote motors capable of rotating forward and reverse, the motors h5 and h6 being mounted to one side frame v2 of the cans exchanging carrier V and having output shafts h5' and h6', respectively, with bevel gears h7 and h8 being mounted on the output shafts h5' and h6', respectively.

Horizontal shafts h9' and h10' having bevel gears h9 and h10 thereon which are in mesh with the bevel gears h7 and h8, respectively, are mounted to the side frame v2 through suitable bearings. Further, cams h11 and h12 each having a short-diameter portion and a long-diameter portion are mounted on the horizontal shafts h9' and h10', respectively.

On the other hand, to the underside of the tilting member k1 are attached cam followers h13 and h14 in abutment with the cams h11 and h12, respectively.

Numeral h15 denotes a shaft supporting block disposed nearly centrally of the floor frame v1 of the cans exchanging carrier V. On the shaft supporting block h15 is carried a horizontal shaft h16' which is mounted to a frame h16 depending from the underside of the tilting member k1.

Though not shown, another shaft supporting block similar to the shaft supporting block h15 is disposed on the floor frame v1 at a predetermined spacing in the traveling direction of the carrier V. Also from the tilting member k1 there depends a frame with a horizontal shaft mounted thereto which shaft is similar to the horizontal shaft h16' and which is carried on the said another shaft supporting block.

Figure 17A:
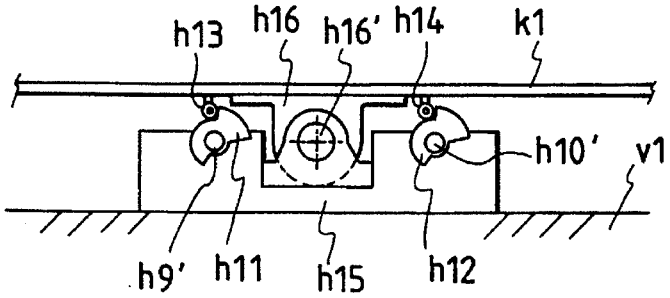
FIGS. 17A and 17B are side views showing the operation of a can tilting member.

In the above construction, by driving the motors h5 and h6 to rotate the cams h11 and h12 through the bevel gears h7, h8 and like gears h9, h10, thereby causing the cams h11 and h12 to assume the same height position in the vertical direction which cams are in abutment with the cam followers h13 and h14 attached to the tilting member k1, as shown in FIG. 17A, the tilting member k1 can be held in a substantially horizontal state.

Figure 17B:
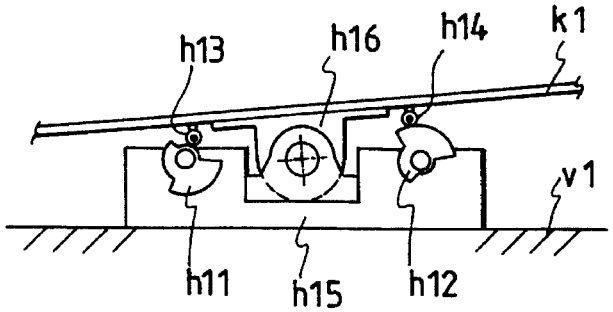

Further, as shown in FIG. 17B, by making the height of the cam h11 abutting the cam follower h13 lower and that of the cam h12 abutting the cam follower h14 higher, the tilting member k1 can be tilted downward on its left-hand side.

Likewise, by making the height of the cam h11 abutting the cam follower h13 higher and that of the cam h12 abutting the cam follower h14 lower, the tilting member k1 can be tilted downward on its right-hand side.

Functions and effects of the above embodiment of the present invention will be described below.

In a spinning machine wherein the spacing between cans is narrow and cans are arranged in plural rows in the longitudinal direction of the spinning machine, empty cans can be replaced with full-loaded cans simultaneously, efficiently and that quickly.

In a spinning machine wherein the can-to-can spacing is narrow and there are plural rows of cans arranged longitudinally of the machine, empty cans can be carried out from the rows of cans through a space which can be small if only the empty cans can be tilted therein. Thus, a small space suffices for the replacement of empty cans with full-loaded cans, thereby permitting effective utilization of space, for example, permitting arrangement of a larger number of spinning machines.

Since full-loaded cans can be carried into the carried-out position of empty cans by only movement of the cans exchanging carrier in the longitudinal direction of the spinning machine, it is possible to reduce the spacing between adjacent spinning machines, whereby there is attained effective utilization of space, such as arrangement of a larger number of spinning machines.

Since the can transfer device disposed on the cans exchanging carrier is advanced and retreated in a telescopic fashion with respect to each spinning machine, it is possible to construct the same carrier in a compact form, that is, the spacing between adjacent spinning machines can be made smaller, thereby permitting effective utilization of space such as arrangement of a larger number of spinning machines.

Since the can resting member is tilted by a tilting motion of the tilting member in the can transfer device, the can resting member can be inserted easily and that quickly into the space between the undersides of empty cans which have been tilted by the urging member and the floor.

Also in the case of taking down the full-loaded cans from the can resting member, it is possible to reduce the difference in height between the can resting member and the floor surface because the can resting member is in a tilted state, thus permitting the full-loaded cans to be put down smoothly from the can resting member.

Since the can resting member is moved by engagement of the rack plate with a chain which rack plate is mounted nearly centrally of a side wall of the can resting member, the can resting member can move in the spinning frame direction beyond sprocket if only the teeth of the rack plate is in partial engagement with the chain, so that the moving distance of the can resting member can be made long and hence not only the can transfer work can be done positively but also the cans exchanging carrier can be constructed more compactly.

Since the intermediate moving member and the can resting member which constitute the can transfer device are constructed so that they can be moved toward any adjacent spinning machine by rotation of a motor capable of rotating forward and reverse, no consideration is needed about in which direction the cans exchanging carrier is to be carried in between rows of cans unlike a can exchanging carrier wherein cans are loaded and unloaded only in one direction. Consequently, not only the efficiency of the cans exchanging work by the cans exchanging carrier is improved but also the operability of the same carrier is improved.

When the urging member is positioned centrally of the cans exchanging carrier, it is allowed to stand nearly vertically so as not to be an obstacle to the cans on the carrier, then as the urging member moves in the spinning frame direction, it tilts in the horizontal direction, and when pushing the cans, the urging member is advanced while being tilted so as to assume a substantially horizontal state. This construction permits a compact structure of the cans exchanging carrier.

The can abutting side of one urging member is formed as a slant face extending along a part of the outer periphery of a can and a like slant face is formed in another urging member to define a concave portion conforming to the outer peripheral surface of the can, and a portion of the can is brought into abutment with the said concave portion. Therefore, when empty cans are to be pushed and tilted or when the movement of full-loaded cans is to be prevented, there is no fear of the cans tilting or moving in the longitudinal direction of the spinning frame.

Since the urging device mounted to a side frame and that mounted to the central frame are arranged in a mirror-image relation and the endless belts disposed in those urging devices are driven by means of a common motor capable of rotating forward and reverse, the urging members attached to the endless belts can be operated in a synchronized manner.

Since the present invention is constructed as above, there can be attained the following effects.

The moving distance of the can resting member can be made long, so not only the can carrying-in and -out work can be done positively with respect to the rows of cans, but also the cans exchanging carrier can be constructed in a more compact form.

An embodiment of the present invention relating to an automated sliver piecing system will be described below with reference to FIGS. 18 to 41, provided that the invention is not limited thereto as long as the gist of the invention is observed.

Description will be directed below to the sliver piecing system disposed above the can transfer device M on the cans exchanging carrier V and with cans carried thereon.

Figure 18:
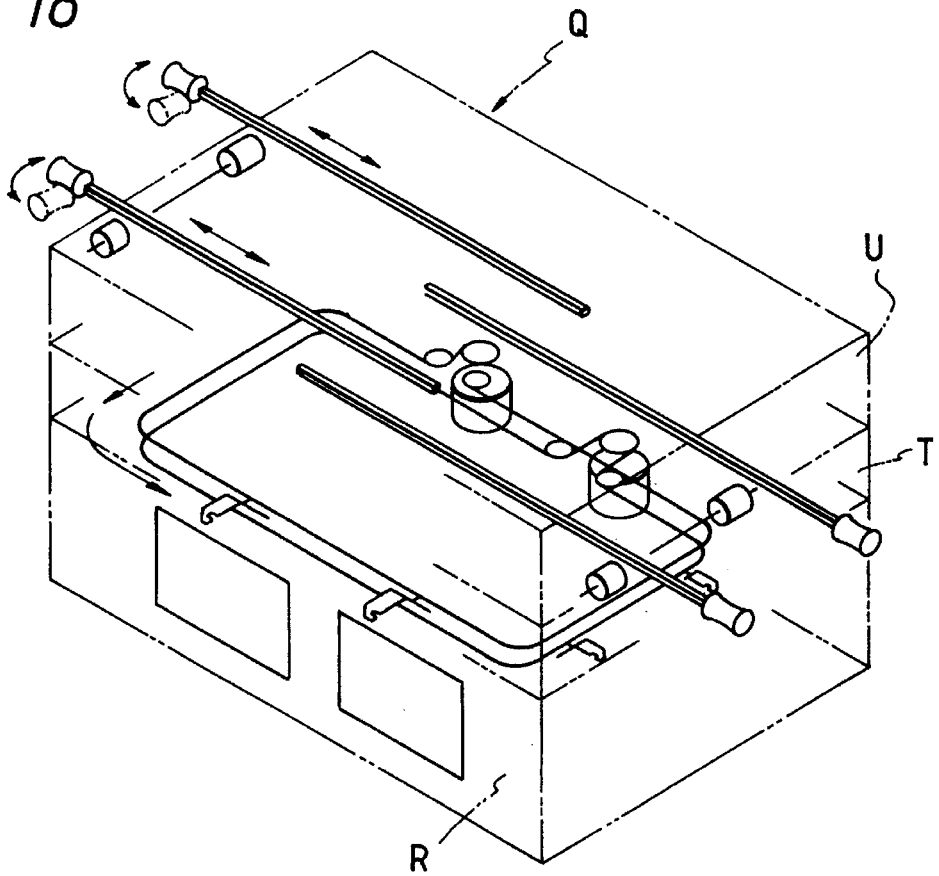
FIG. 18 is a schematic perspective view of a sliver piecing system.

The sliver piecing system Q disposed on the cans exchanging carrier V is mainly composed of a sliver guide device U disposed at an upper stage of the sliver piecing system Q, a sliver transfer device T disposed at a middle stage and a pair of sliver piecing body devices R disposed at a lower stage, as shown in FIG. 18 which is a schematic perspective view of the sliver piecing system Q.

Before explaining the sliver guide device U, sliver transfer device T and sliver piecing body devices R, the operation of each of them, etc. will be outline below with reference to FIGS. 19 to 24 which are schematic perspective views and enlarged perspective views of the cans exchanging carrier V, etc.

Figure 19:
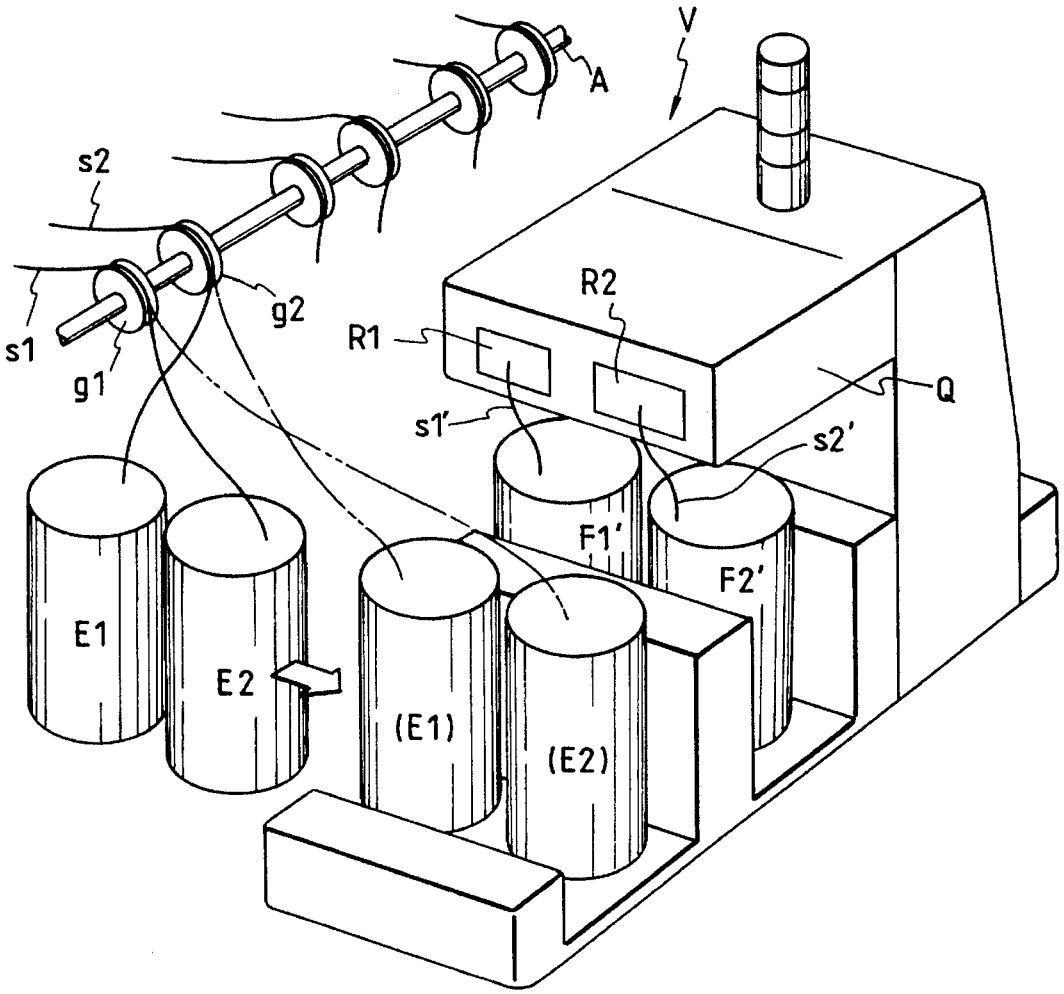
FIG. 19 is a schematic perspective view of a cans exchanging carrier having a sliver piecing system, etc.

In the state illustrated in FIG. 19, the cans exchanging carrier V has stopped in such a manner that the front faces of empty cans E1 and E2 which are feeding old slivers s1 and s2 ("old slivers" will be mentioned below when reference is made to old slivers at large) to the spinning frame S are positioned in front of the empty can resting space on the carrier V, and the empty cans E1 and E2 have been put onto the carrier by means of the can transfer device M disposed on the carrier.

In this state, old slivers s1 and s2 are still fed to the spinning frame S from the empty cans R1 and E2 on the carrier V. Further, end portions of new slivers s1' and s2' ("new sliver s"' will be mentioned below when reference is made to new slivers at large) from the full-loaded cans F1' and F2' on the sliver piecing carrier V are located in sliver piecing positions of sliver piecing body devices R1 and R2 ("sliver piecing body device R" will be mentioned below when reference is made to sliver piecing body devices at large) by means of a device to be described later. In FIG. 19, an end portion of the new sliver s1' from the full-loaded can F1' is positioned in the sliver piecing body device R1 and that of the new sliver s2' from F2' positioned in R2.

Figure 20:
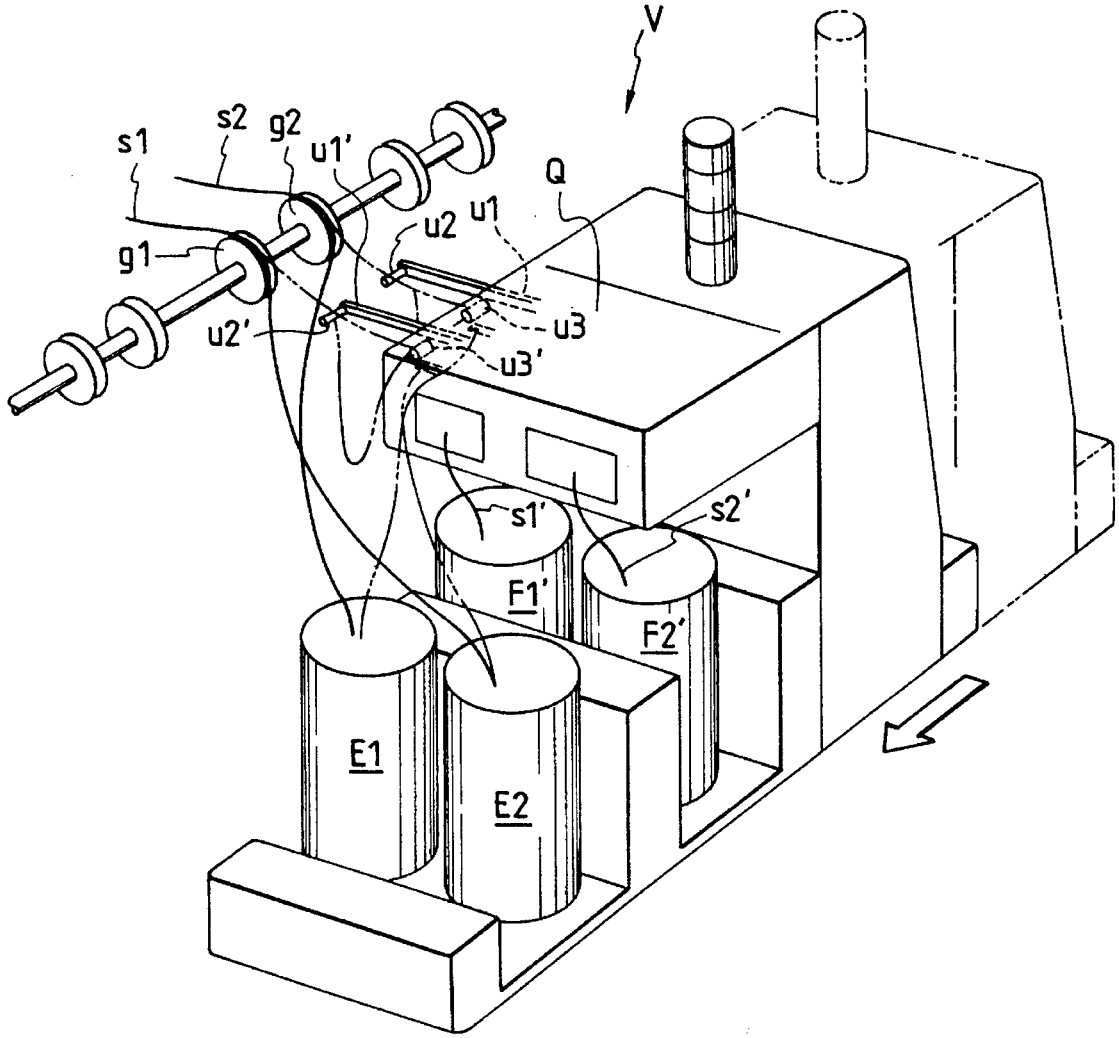
FIG. 20 is schematic perspective view similar to FIG. 19, showing the cans exchanging carrier, etc.

Next, as shown in FIG. 20, the cans exchanging carrier V is moved so that the full-loaded cans F1' and F2' on the cans exchanging carrier V are positioned in front of the carried-out position of the empty cans E1 and E2.

Figure 21:
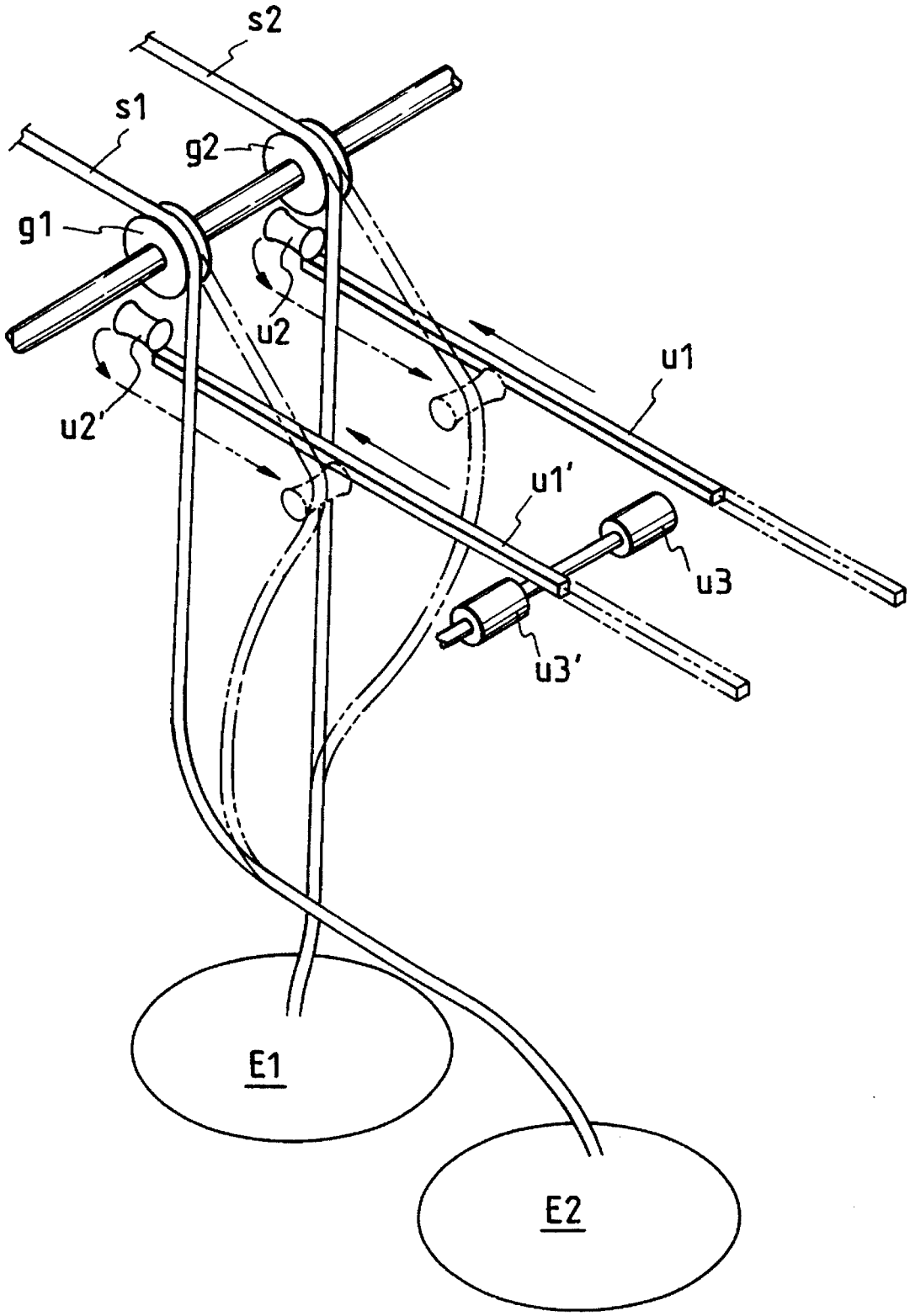
FIG. 21 is a partially enlarged perspective view of the sliver piecing system, etc.

Thereafter, as shown in FIG. 21, sliver draw-up members u1 and u1' of the sliver guide device which will be described later are advanced in such a manner that the axes of draw-up rollers u2 and u2' disposed at the front ends of the sliver draw-up members u1 and u1', respectively, are almost coincident with the axes of the sliver draw-up members u1 and u1'.

When the draw-up rollers u2 and u2' have passed the sliver guides g1, g2 and further passed the old slivers s1 and s2 which are being fed from the empty cans E1' and E2' to the spinning frame S, the draw-up rollers u2 and u2' are turned so that their axes intersect the axes of the sliver draw-up rollers u1 and u1' nearly perpendicularly, as indicated by a dash-double dot line in FIGS. 20 and 21. At the same time, the sliver drawup rollers u1 and u1' are moved back, allowing the old slivers s1 and s2 to be drawn up to the cans exchanging carrier V. The old slivers s1 and s2 are then held grippingly by both the draw-up rollers u2, u2' and driving rollers u3, u3' which are disposed in the sliver piecing system Q and which are driven rotatively by means of a drive unit to be described later.

Figure 22:
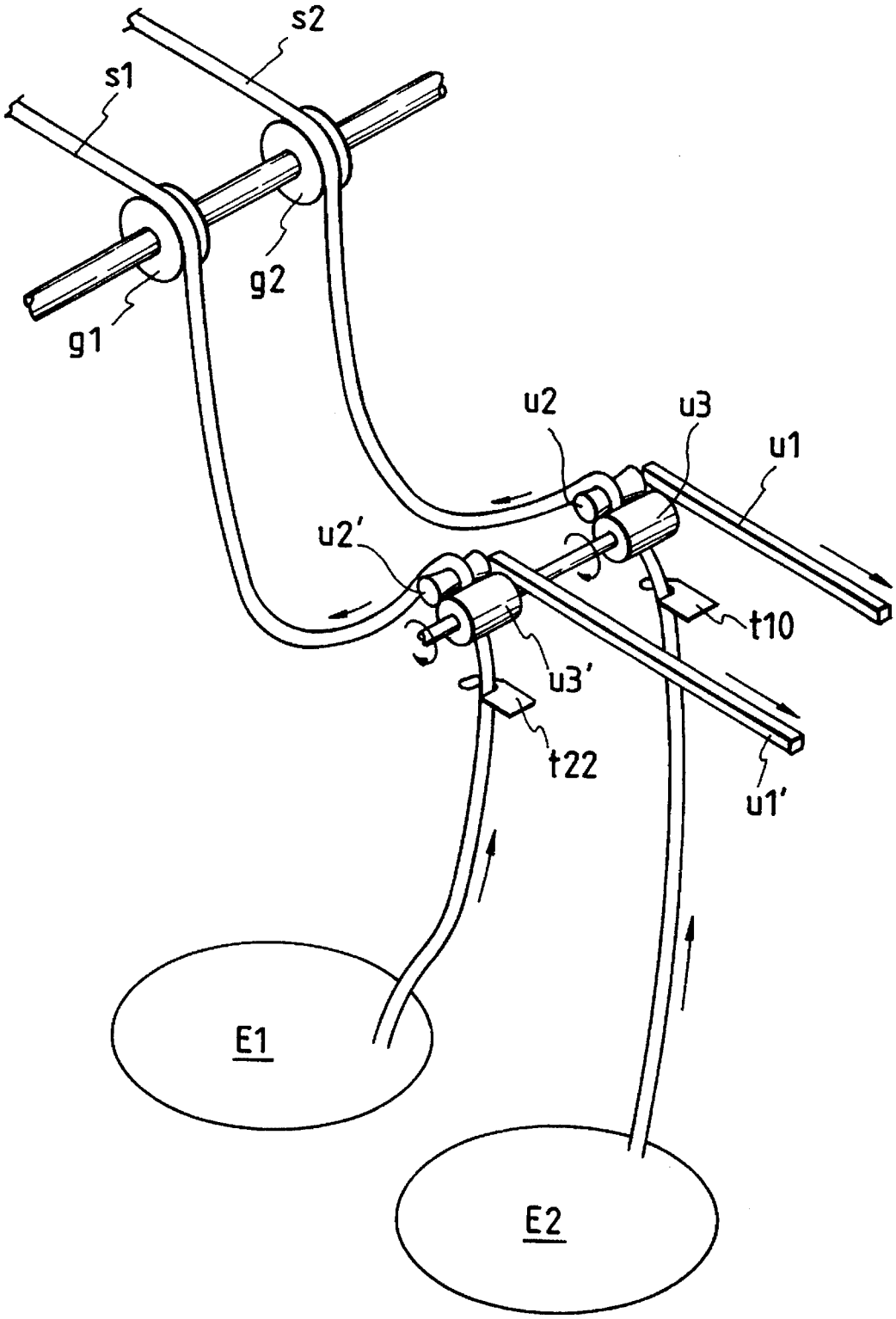
FIG. 22 is a partially enlarged perspective view similar to FIG. 21, showing the sliver piecing system, etc.

Then, as shown in FIG. 22, the old slivers s1 and s2 are drawn out from the empty cans E1 and E2 on the cans exchanging carrier V by rotating the driving rollers u3 and u3' and are allowed to slack a predetermined length between the sliver guides g1, g2 and the draw-up rollers u2, u2'.

The slack length of the old slivers s1 and s2 between the sliver guides g1, g2 and the draw-up rollers u2, u2' is set so as not to cause breaking of the slivers also during continuous operation of the spinning frame S in consideration of the time required from start to end of the sliver piecing operation by the sliver piecing system Q and the feed rate of the old slivers s1, s2.

Figure 23:
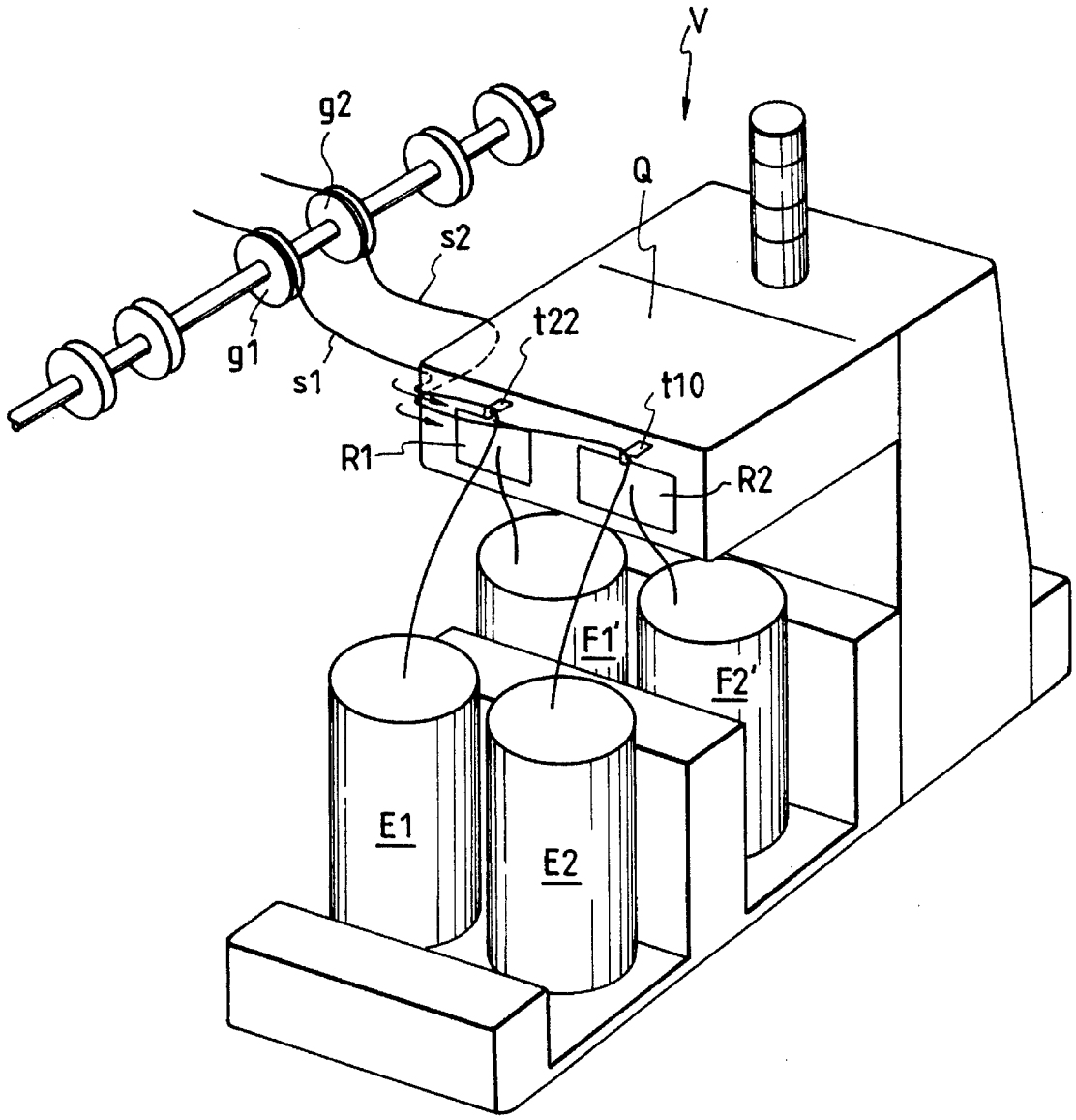
FIG. 23 is a schematic perspective view similar to FIG. 19, showing the cans exchanging carrier, etc.

Then, as shown in FIG. 23, the old slivers s1 and s2 slacking between the sliver guides g1, g2 and the draw-up rollers u2, u2' are transferred up to the paired sliver piecing body devices R1 and R2 which are disposed in a plane orthogonal to the traveling direction of the cans exchanging carrier V and which will be described later, by means of transfer hooks t10 and t22 of the sliver transfer device T to be described later.

Thereafter, the rotation of the driving rollers u3 and u3' is stopped to discontinue the delivery of the old slivers s1 and s2 from the empty cans E1 and E2. Then, the old slivers s1 and s2 are cut and the old sliver s1 thus cut and the new sliver s1' from the full-loaded can F1' are pieced together, while the old sliver s2 thus cut and the new sliver s2' from the full-loaded can F2' are pieced together, by means of the sliver piecing body devices R1 and R2.

Figure 24:
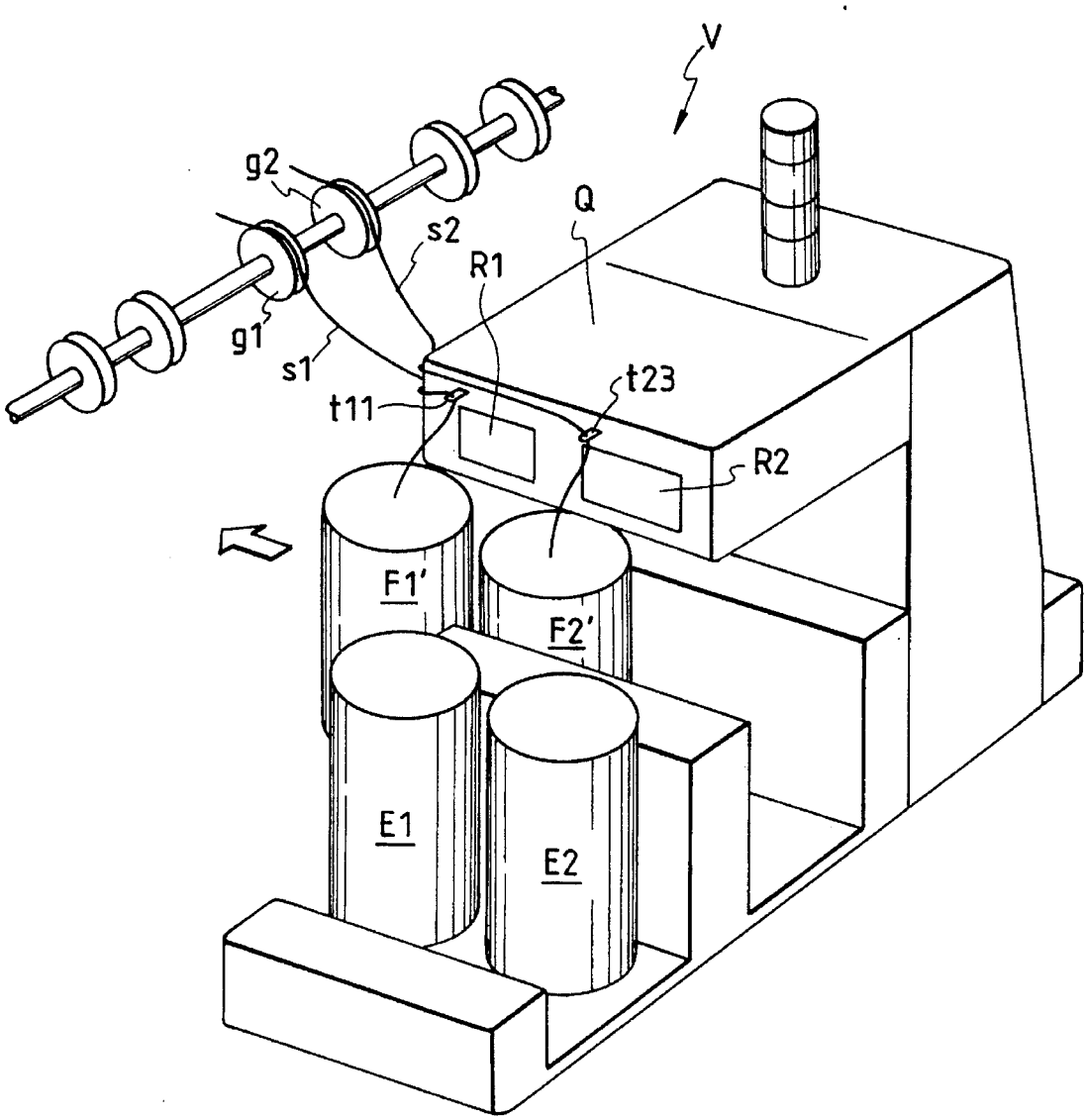
FIG. 24 is a schematic perspective view similar to FIG. 19, showing the cans exchanging carrier, etc.

After completion of the piecing between end portions of the old slivers s1, s2 and those of the new slivers s1', s2' from the full-loaded cans F1', F2' on the cans exchanging carrier V, the full-loaded cans F1' and F2' are carried to the carried-out positions of the empty cans E1 and E2, as shown in FIG. 24, while lower stage-side transfer hooks t11 and t23 of the sliver transfer device T disposed above the sliver piecing body devices R1 and R2 are synchronized with the movement of the pieced slivers toward the spinning frame S.

The sliver piecing operation is completed in the above manner. According to the sliver piecing system Q disposed above the cans exchanging carrier V, since the paired sliver piecing body devices R1 and R2 are disposed, it is also made possible to effect piecing of old slivers from empty cans located behind the adjacent spinning frame S which is disposed on the opposite side with new slivers from full-loaded cans on the cans exchanging carrier V.

Thus, taking into account the position of the sliver guide device U, etc., as mentioned previously, the two sliver piecing body devices R1 and R2 are arranged laterally side by side in a plane orthogonal to the traveling direction of the cans exchanging carrier V in other words, on the surface of the carrier V generally parallel to the plane orthogonal to the longitudinal direction of the spinning frame S.

Reference will now be made below to the sliver guide device U, sliver transfer device T and sliver piecing body device R as constituents of the sliver piecing system Q which performs the sliver piecing work described above.

First, the sliver guide device U will be described below with reference to FIG. 25 which is a plan view of the device U, FIG. 26 which is an enlarged plan view of a principal portion of the device U, FIG. 27 which is a sectional view taken along line I—I in FIG. 26, and FIG. 28 which is an enlarged perspective view of an end portion of the sliver draw-up member u1.

The sliver guide device U is disposed two on each side face of the sliver piecing system Q facing the rows of cans in the spinning frame S so as to permit piecing of slivers on any side of adjacent spinning frames. However, since all of them are of the same construction except their positions, the one located in the left upper position in FIG. 25 will be described below.

Figure 27:
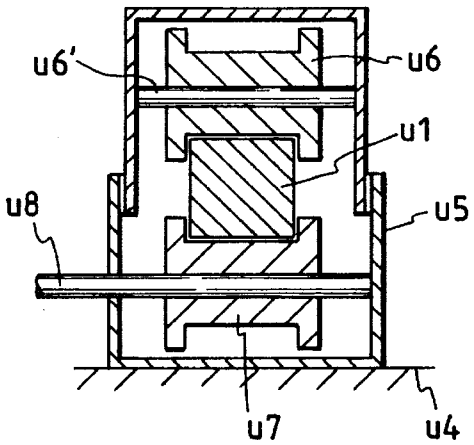
FIG. 27 is a sectional view taken along line I—I in FIG. 26.

As shown in FIG. 27, the sliver draw-up member u1 is formed as a rod having a generally square section and it is disposed in a suitable frame u5 mounted on a base plate u4 which carries the sliver guide device U thereon.

The sliver draw-up member u1 is held grippingly by rollers 6 and 7 disposed up and down, respectively, and having concave portions for fitting therein of the sliver draw-up member u1 which is generally square in section. The upper roller u6 is pivotally secured through a suitable bearing (not shown) onto a horizontal shaft u6' which is mounted to the frame u5, while the lower roller u7 is mounted on a shaft u8.

Figure 25:
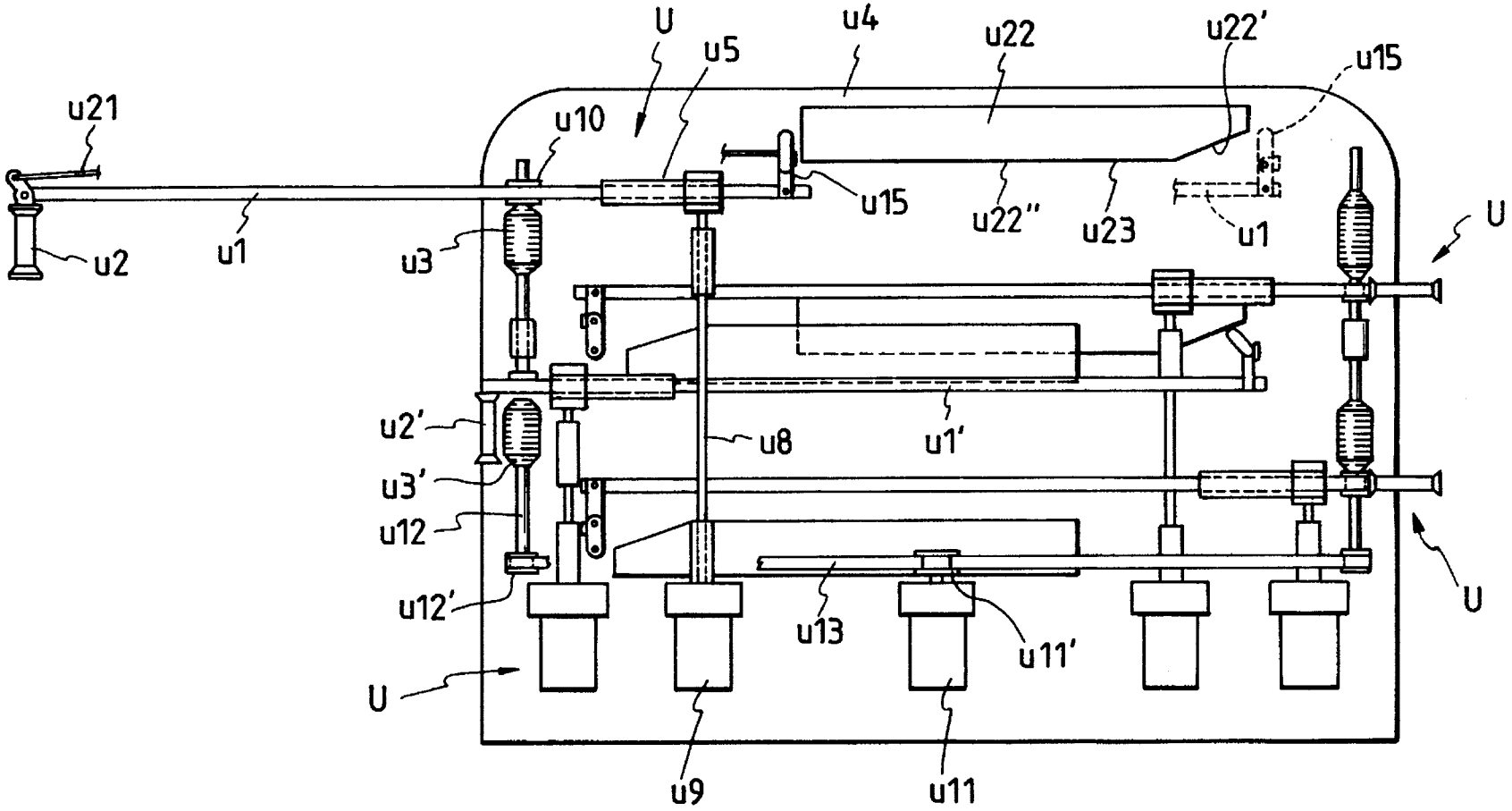
FIG. 25 is a plan view of a sliver guide device.

As shown in FIG. 25, the shaft u8 is driven rotatively by means of a motor u9 mounted on the base plate u4 and capable of rotating forward and reverse. A support roller u10 which supports the sliver draw-up member u1 is disposed on the base plate 4 in a position close to the spinning frame rotatably through a suitable frame (not shown).

A motor u11 capable of rotating forward and reverse is mounted on the base plate u4, and a belt u13 is stretched between a pulley u11' mounted on an output shaft of the motor u11 and a pulley u12' mounted on one end portion of a shaft u12 which is disposed on the spinning frame-side side face of the base plate u4 generally in parallel through a suitable bearing.

On the shaft u12 is mounted the driving roller u3. The driving roller u3 nips the old slivers in cooperation with the draw-up roller u2 disposed at the front end of the sliver draw-up member u1 and allows the old sliver s2 to slack a predetermined length between the sliver guide g2 and the roller u2, as shown in FIG. 22.

In the above construction, by driving the motor u9 to rotate the u7 mounted at the front end of the shaft u8, the sliver draw-up member u1 which is held grippingly between the rollers u6 and u7 and which are guided and supported by the support roller u10, can be moved retreatably in the transverse direction in FIG. 25, namely, in the direction of the sliver guide g in the spinning frame S.

Figure 26:
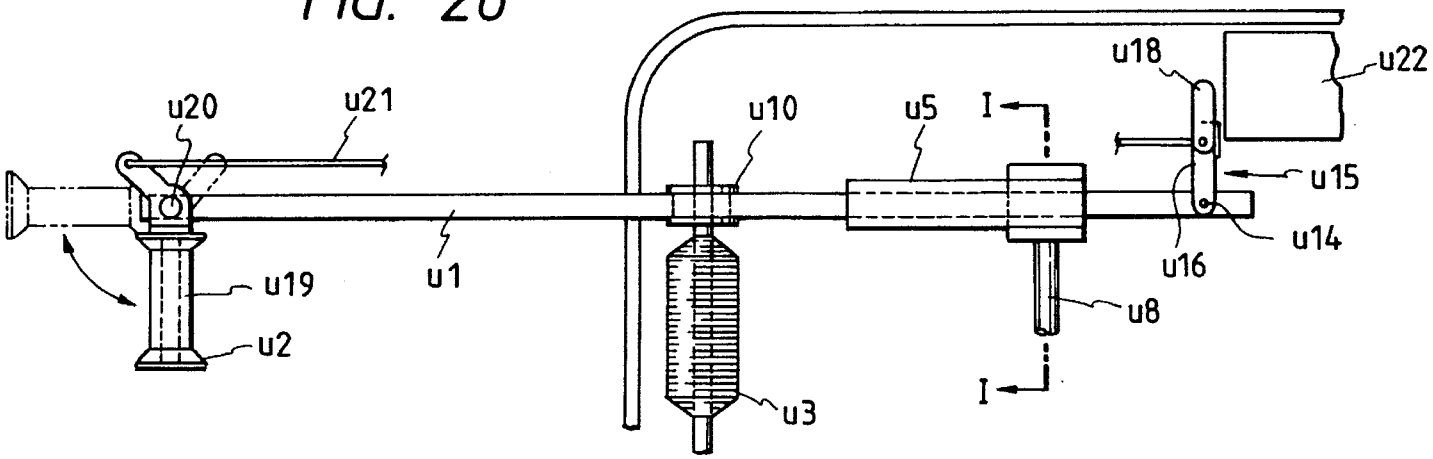
FIG. 26 is an enlarged plan view of a principal portion of the sliver guide device.
Figure 28:
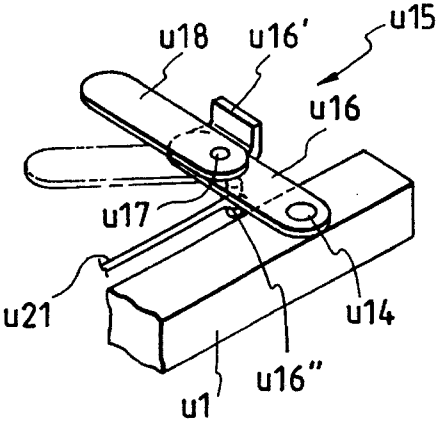
FIG. 28 is an enlarged perspective view of an end portion of a sliver draw-up member.

Now, with reference to mainly FIGS. 26 and 28, the following description is provided about means for turning the draw-up roller u2 disposed at the front end of the sliver draw-up member u1 in the axial direction of the same member and also in the direction nearly orthogonal to the said axis.

A short shaft u15 adapted to rotate about a pin u14 attached to the sliver draw-up member u1 is mounted on the end portion of the member u1 opposite to the end portion where the draw-up roller u2 is disposed.

The short shaft u15 comprises a first shaft half u16 having a projection u16' which is erected approximately vertically from a side portion of the front end of the shaft half u16 on the side opposite to the roller u2 side, and a second shaft half u18 connected to the first shaft half u16 pivotally through a pin u17 attached to the shaft half u16. The first shaft half u16 can rotate in both clockwise and counterclockwise directions in FIG. 26 around the pin u14. On the other hand, the clockwise rotation of the second shaft half u18 is prevented by the projection u16' erected on the first shaft half u16 although it can rotate counterclockwise from the state shown in FIG. 26 wherein the first and second shaft halves u16, u18 are substantially aligned with each other.

The second shaft half u18 is normally biased so as to maintain such alignment of both shaft halves by means of a suitable spring member, e.g., coiled spring, (not shown) disposed around the pin u17.

A support shaft u19 which supports the draw-up roller u2 rotatably is pivotally mounted on a pin u20 attached to an end portion of the sliver draw-up member u1, and it is normally biased so that the axis of the draw-up roller u2 is approximately orthogonal to the axis of the sliver draw-up member u1, as indicated by a solid line in FIG. 26, by means of a suitable spring member, e.g., coiled spring (not shown) disposed around the pin u20.

Further, one end of wire u21 is attached to the support shaft u19 on the side opposite to the roller u2 supporting side with respect to the pin u20. The opposite end of the wire u21 is attached to a pin 16" projecting from the underside of nearly the front end portion of the first shaft half u16 as a constituent of the short shaft u15.

On the other hand, a generally rectangular cam u22 having a slant portion u22' in the lower right corner position in FIG. 25 and approximately parallel to the axis of the sliver draw-up member u1 is disposed sideways of the base plate u4. In FIG. 25, the cam u22 has a cam surface u23 comprising a lower long side u22" and the slant portion u22'.

In the illustrated construction, the front end portion of the second shaft half u18 as a constituent of the short shaft u15 comes into engagement with the cam surface u23. Where required, a cam follower, e.g., roller, may be disposed at the front end of the second shaft half u18.

The operation of the sliver guide device U constructed as above will be described below.

In the most retreated, stand-by position of the sliver draw-up member u1, as indicated partially by a chain line in FIG. 25, the front end portion of the second shaft half u18 is not in engagement with the cam u22, so that the axis of the draw-up roller u2 is kept approximately orthogonal to the axis of the sliver draw-up member u1 by virtue of a suitable spring member, e.g., coiled spring, disposed around the pin u20.

Next, by driving the motor u9 and thereby rotating the roller u7 mounted on the front end portion of the shaft u8, the sliver draw-up member u1 held grippingly between the rollers u7 and u6 is moved leftward in FIG. 25.

With the leftward movement of the sliver draw-up member u1, the front end portion of the second shaft half u18 comes into engagement with the slant portion u22' of the can u22 and then with the lower long side u22". Consequently, the short shaft 15 comprising the second shaft half u18 and the first shaft half u16 whose projection u16' is in abutment with the shaft half u18, turns clockwise about the pin u14.

With the clockwise rotation of the short shaft u15, the wire is pulled rightward in FIG. 25, so that the axis of the draw-up roller u2 turns clockwise about the pin u20 against the biasing force of a suitable spring such as a coiled spring disposed around the pin u20 and comes into substantial alignment with the axis of the sliver draw-up member u1, as indicated by a dash-double dot line in FIG. 26.

In such a state of alignment of the axis of the draw-up roller u2 with that of the sliver draw-up member u1, the member u1 advances, and when the roller u2 has passed the old sliver s2 being fed from the empty can E1 on the cans exchanging carrier V to the spinning frame S, as shown in FIG. 21, the front end portion of the second shaft half u18 is disengaged from the cam surface u23 of the cam u22, so that the roller u22 rotates counterclockwise about the pin u20 until it substantially intersects the axis of the sliver draw-up member u1 perpendicularly.

Thereafter, the motor u9 is driven to move the sliver draw-up member u1 rightward in FIG. 25, thereby causing the old slivers to be engaged with the draw-up roller u2 and drawn up toward the driving roller u3.

At the time of the rightward movement of the sliver draw-up member u1, the second shaft half u18 of the short shaft 15 comes into abutment with the cam u22. However, as mentioned previously, since the shaft half u18 can turn counterclockwise about the pin u17, the draw-up roller u2 does not rotate in the direction in which its axis is aligned with that of the sliver draw-up member u1. Thus, there is no fear of disengagement of the old slivers from the roller u2.

Then, when the draw-up roller u2 which holds the old slivers has come into contact with the driving roller u3 and the old slivers has been nipped by both rollers u2 and u3, the motor u9 is turned off to stop the movement of the sliver draw-up member u1.

Next, the motor u11 capable of rotating forward and reverse is driven to rotate the driving roller u3 through pulley u11', belt u13 and pulley u12', whereby the old slivers s1 and s2 are drawn out from empty cans E1 and R2 and are allowed to slack a predetermined length between the sliver guides g1, g2 and the draw-up rollers u2, u2'. Thereafter, the motor u11 is turned off.

By performing the above operations in each sliver guide device U, the old slivers can be drawn out from empty can E on the can exchanging carrier V and slackened a predetermined length between the sliver guide g and the draw-up roller u2.

Now, the sliver transfer device T will be described below with reference to FIG. 29 which is a plan view of the device T disposed at the middle stage of the sliver piecing system Q and FIG. 30 which is a partially enlarged perspective view of the device T.

Numerals t1 to t4 denote guide rollers disposed on an upper base plate t5 in positions corresponding to corners of a generally rectangular shape, and numerals t6 and t7 denote guide rollers for guiding and winding an endless belt t9 onto a pulley t8' mounted on an output shaft of a motor t8 disposed on the upper plate t5 and capable of rotating forward and reverse, the endless belt t9 being entrained on guide rollers t1 to t4.

As mentioned previously, after the old slivers s1, s2 from two empty cans E1, E2 on the cans exchanging carrier V and the new slivers s1', s2' from the two full-loaded cans F1', F2' on the carrier V have been pieced together, two full-loaded cans F1 and F2 on the carrier V are simultaneously carried into the rows of cans in the spinning frame S. To this end, a pair of sliver piecing body devices R1 and R2 are disposed laterally at a predetermined spacing on an upper side portion of the cans exchanging carrier V orthogonal to the traveling direction.

For transferring and positioning two old slivers s1 and s2 to the sliver piecing positions in the paired sliver piecing body devices R1 and R2, blocks t12 are attached to the endless belt t9 at a suitable spacing through a telescopic lever t14, with transfer hooks t10 and t11 being attached to the blocks t12, the transfer hooks t10 and t11 having recesses t10' and t11', respectively, which recesses face each other. In FIG. 30 there is shown only one block t12 attached to the endless belt t9.

As the telescopic lever t14 there may be used a spring member such as a coiled spring having a suitable resilience.

Below the endless belt t9 is disposed an endless belt t24 having the same construction as that of the endless belt t9. Also to the endless belt t24 there are mounted blocks t13 at a suitable spacing through a telescopic lever t15, with transfer hooks t22 and t23 being attached to the blocks t13, the transfer hooks t22 and t23 having recesses t22' and t23', respectively, which recesses face each other. In FIG. 30 there is shown only one block t13 attached the endless belt t24.

Figure 30:
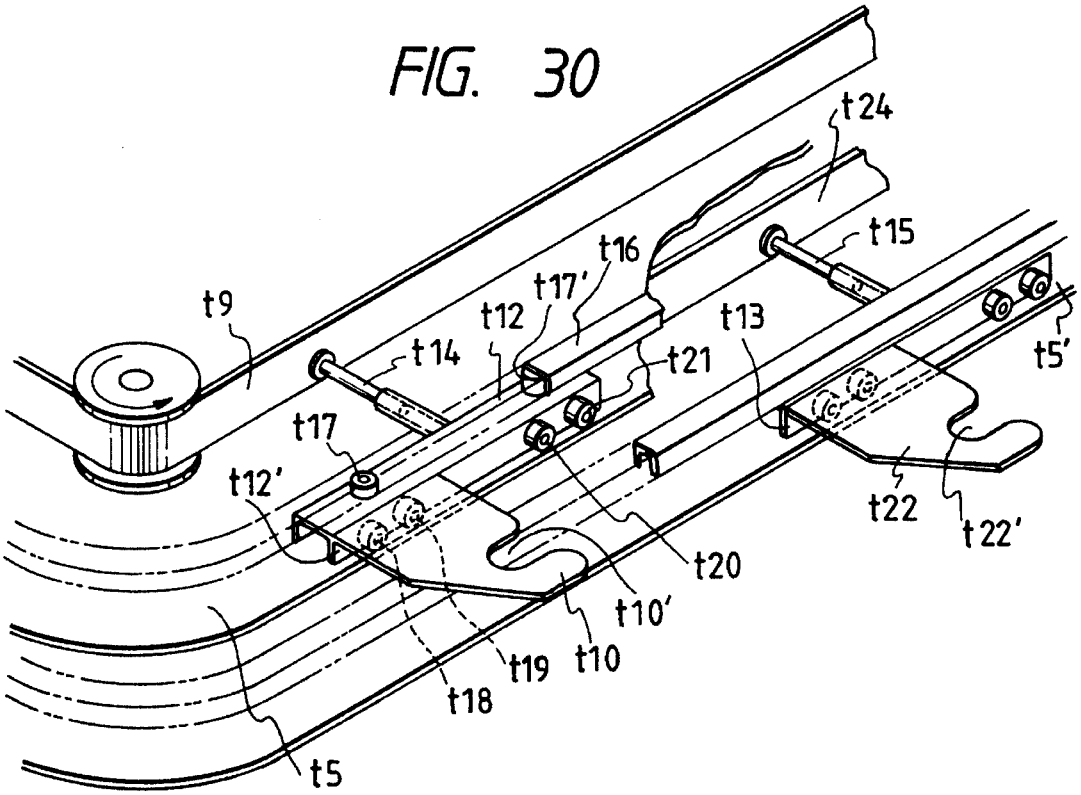
FIG. 30 is a partially enlarged perspective view thereof.

The construction of the block t12 with transfer hook t10 attached thereto and that of the block t13 with transfer hook t22 attached thereto, which are conveyed by the upper and lower endless belts t9 and t24, respectively, in FIG. 30, are the same. Therefore, only the transfer hook t10 and block t12 which are located in upper positions will be referred to in the following description.

On the upper surface of the block t12 are disposed a suitable number of guide rollers t17 and t17' rotatably which rollers are fitted in the concave portion of a generally rectangular rail t16 disposed around the endless belt t9 and having a ⊐-shaped section with the lower portion being open.

On a side face t12' of the block t12 with transfer hook t10 attached thereto there are disposed a suitable number of guide rollers t18 to t21 each mounted rotatably on a nearly horizontal shaft. The guide rollers t18 to t21 are constructed so as to roll on the upper base plate t5. On the other hand, like guide rollers disposed on a side face of the block t13 located in a lower position are constructed to roll on a lower base plate t5'.

Figure 29:
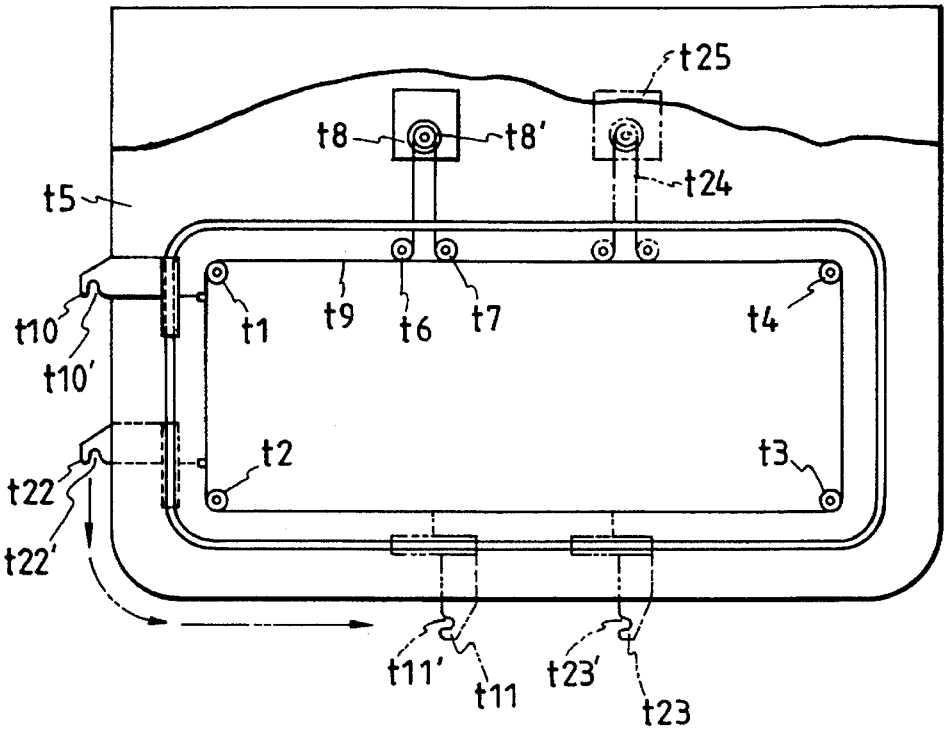
FIG. 29 is a plan view of a sliver transfer device.

As mentioned previously, the sliver transfer device T is disposed in two stages vertically, and in FIG. 29, the endless belt t24 of the sliver transfer device T positioned in the lower stage is constructed so as to be moved by means of a motor t25 capable of rotating forward and reverse.

The operation of the sliver transfer device T having the above construction will be described below.

As described above, the old slivers s1 and s2 are brought into engagement with the draw-up rollers u2 and u2' and are thereby drawn up toward the driving rollers u3 and u3'. At the same time, the old slivers s1 and s2 from empty cans E1 and E2 on the cans exchanging carrier V are drawn out and are allowed to slack between the sliver guides g1, g2 and the draw-up rollers u2, u2'. While the sliver guide U performs this operation, the transfer hooks t10 and t22 are in their stand-by positions so that the old slivers s1 and s2 which have been drawn up are positioned sideways of the recesses t10' and t22', as shown in FIGS. 20 and 29.

After the old slivers s1 and s2 have been slackened a predetermined length between the sliver guides g1, g2 and the draw-up rollers u2, u2', the motors t8 and t25 are driven to rotate the endless belts t9 and t24 counterclockwise in FIG. 29, allowing the old slivers s1 and s2 positioned sideways of the recesses t10 and t22' of the transfer hooks t10 and t22 to be engaged with the recesses t10' and t22', whereby the old slivers are transferred up to the corresponding, paired sliver piecing body devices R1 and R2.

After the old slivers s1, s2 from two empty cans E1, E2 on the cans exchanging carrier V and the new slivers s1', s2' from two full-loaded cans F1', F2' on the same carrier have been pieced together by the paired sliver piecing body devices R1 and R2 to be described later, the two full-loaded cans F1' and F2' on the carrier V are simultaneously carried into the rows of cans in the spinning frame S. In this case, the motors t8 and t25 are driven to turn the transfer hooks t11 and t23 to turn clockwise in FIG. 29 in synchronism with the movement of the full-loaded cans F1' and F2' in the spinning frame S direction, whereby the new slivers s1' and s2' from the full-loaded cans F1' and F2' after completion of sliver piecing are transferred positively to the spinning frame S side.

According to this construction, it is possible to prevent excess tension from being applied to the new slivers s1' and s2' after completion of sliver piecing which tension would cause breaking of the new slivers.

In the case where the above cans exchanging and sliver piecing operations are to be conducted in the spinning frame S positioned rightward in FIG. 29, the transfer hooks t11 and t23 perform the foregoing motions of the transfer hooks t10 and t22.

The following description is now provided about a new sliver end transfer device B which is for transferring the new sliver s' depending from an edge of the full-loaded can F! on the cans exchanging carrier V up to a sliver piecing position to be described later, with reference to FIG. 31 which is a side view of the new sliver end transfer device B and FIG. 32 which is a front view thereof.

Figure 32:
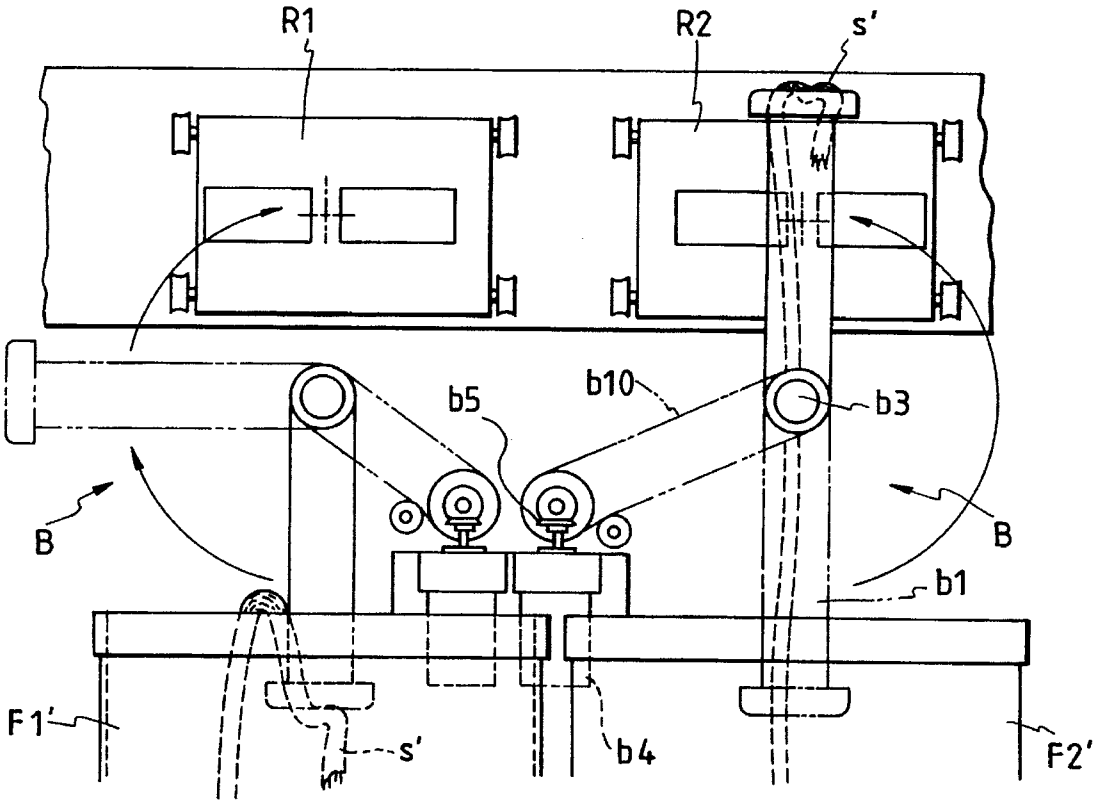
FIG. 32 is a front view thereof.

The new sliver end transfer device is disposed two as B1 and B2 correspondingly to the paired sliver piecing body devices R1 and R2 which are arranged laterally at a predetermined spacing, as shown in FIG. 32. Since both are of the same construction, only the one located on the right-hand side in FIG. 32 will be described below.

Numeral b1 denotes a suction arm having a suction hole b2 at the front end thereof for sucking in an end portion of the new sliver s'. By the following means, the suction arm b1 can be rotated from its lower position indicated with a solid line in FIG. 31 to its upper position indicated with a dash-double dot line in the same figure about a horizontal shaft b3 mounted to a suitable frame of the cans exchanging carrier V.

Numeral b4 denotes a motor capable of rotating forward and reverse and mounted on a suitable frame of the cans exchanging carrier V. A bevel gear b5 is mounted on a generally vertical output shaft of the motor b4, and a bevel gear b7 mounted on a horizontal shaft b6 is in mesh with the bevel gear b5.

A pulley b8 is mounted on the horizontal shaft b6, and a belt b10 is stretched between the pulley b8 and a pulley b9 mounted on the horizontal shaft b3 with the suction arm b1 secured thereto.

Figure 31:
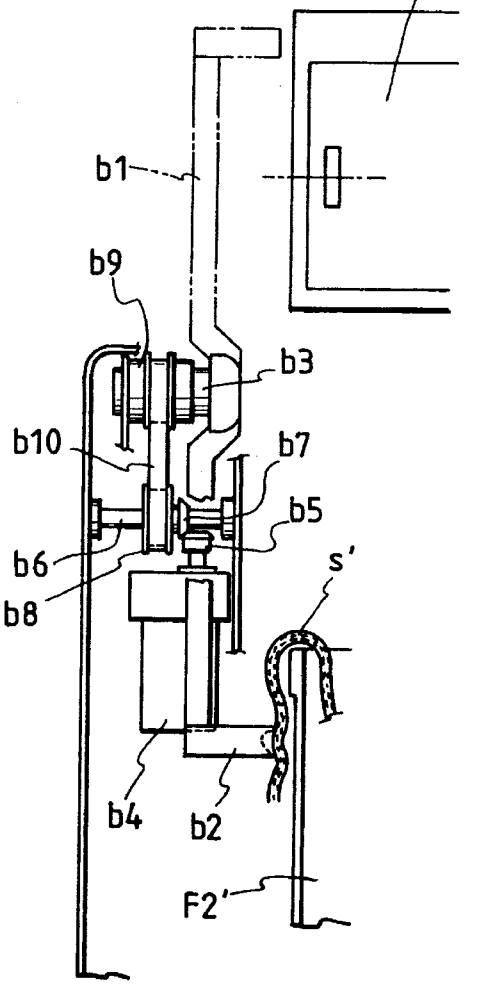
FIG. 31 is a side view of a new sliver end transfer device.

Therefore, by driving the motor b4 to rotate the horizontal shaft b3 forward or reverse though bevel gears b5, b7, pulley b8, belt b10 and pulley b9, the suction arm b1 can be turned between its lower position indicated with a solid line in FIG. 31 and its upper position indicated with a dash-double dot line in the same figure.

The sliver piecing body device R will be described below. First, description will be directed to constituent members of the device R with reference to FIG. 33 which is a plan view of the device R.

As mentioned previously, a pair of sliver piecing body devices R1 and R2 are disposed laterally at a predetermined spacing on the cans exchanging carrier V. However, since both are of the same construction, only one sliver piecing body device R will be referred to below.

The sliver piecing body device R is disposed on the side perpendicular to the moving direction of the cans exchanging carrier V and is made movable forward and backward in the moving direction of the carrier V by means a sliver piecing body moving device which will be described later.

Numeral r1 denotes a sliver piecing body, to which are mounted a suitable number of wheels r2 and r2', the wheels r2 and r2' being put on rails v1 and v1' laid on the cans exchanging carrier V, so that the sliver piecing body r1 can be reciprocated in the moving direction of the carrier V by means of a sliver piecing body moving device to be described later.

Numerals r3 and r3' denote a pair of plate-like piecing members disposed in an opposed relation to each other and which are connected to slide members r5 and r5' through pins r4 and r4'.

The plate-like piecing members r3 and r3' are biased away from each other by means of suitable piecing members such as coiled springs disposed around the pins r4 and r4'.

Numerals r6 and r6' denote guide blocks disposed in the sliver piecing body r1, and the slide members r5 and r5' are fitted in guide slots r7 and r7' (shown, for example, in FIG. 35 which is a perspective view of the sliver body device R) formed in the guide blocks r6 and r6', respectively.

Numerals r8 and r8' denote rods, one ends of which are connected to end portions of the slide members r5 and r5' on the side opposite to the plate-like piecing members r3, r3' side and the opposite ends of which are connected to both ends of a lever r10 which is pivotably secured at a middle part thereof to a vertical shaft r9 erected on the sliver piecing body r1. By moving the lever r10 pivotally within a predetermined angular range using a suitable drive means, the slide members r5 and r5' which are fitted in and guided by the guide slots r7 and r7' formed in the guide blocks r6 and r6', as well as the piecing members r3 and r3' pivotally secured to the slide members r5 and r5', can be allowed slide vertically in an alternate manner in FIG. 33.

Numerals r11 and r11' denote presser members disposed behind the piecing members r3 and r3', respectively. The presser members r11 and r11' press the piecing members r3 and r3' through an appropriate number of rotating rollers r12, r12', r13 and r13' which are mounted to the presser members r11 and r11'. Further, the presser members r11 and r11' can rotate about vertical shafts r14 and r14', respectively, which are erected on the sliver piecing body r1.

The presence of the rollers r12, r12', r13 and r13' in the presser members r11 and r11' permits smooth fitting of the piecing members r3 and r3'.

Numerals r15 and r15' denote horizontal levers formed integrally with the presser members r11 and r11', respectively. One ends of rods r16 and r16' are connected to the front end portions of the horizontal levers r15 and r15', respectively, while the opposite ends thereof are connected to the front end portions of levers r17 and r17', respectively, which are moved pivotally in accordance with the motion of one of known cams (not shown).

Figure 33:
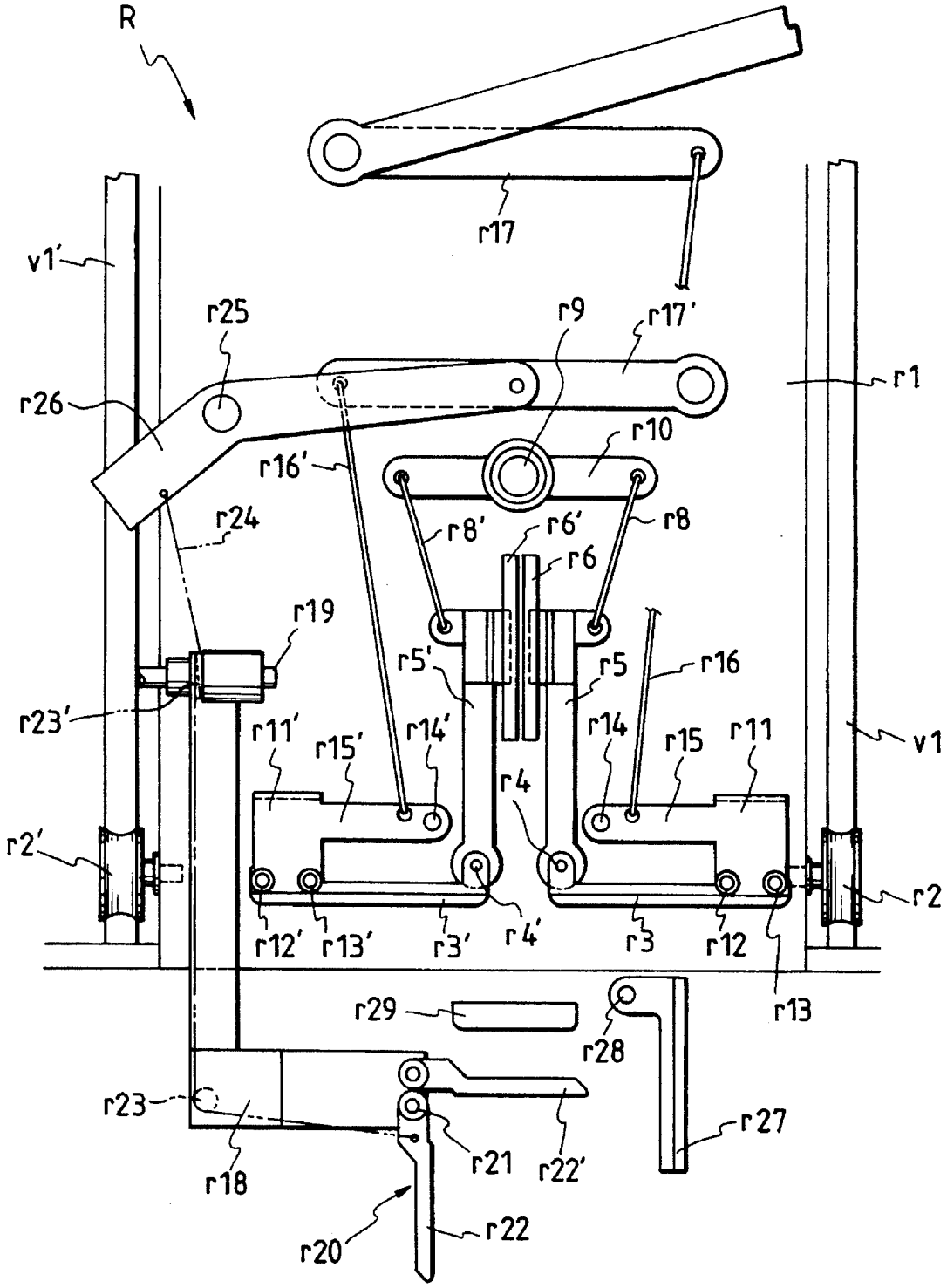
FIG. 33 is a plan view of a sliver piecing body device.

In FIG. 33, therefore, by moving the levers r17 and r17' pivotally downward to pull down the rods r16 and r16', the presser members r11 and r11' are moved pivotally in toward each other about the vertical shafts r14 and r14', namely, in the vertical direction.

With such a pivotal motion of the presser members r11 and r11', the presser members r11 and r11' cause the piecing members r3 and r3' to move pivotally in the vertical direction about the pins r4 and r4' through the rotating rollers r12, r12', r13 and r13' and nip the old sliver s and new sliver s' located between the piecing members r3 and r3' which will be described later.

Thereafter, by moving the lever r10 pivotally using a suitable drive means, the piecing members r3 and r3' are fitted together alternately in the vertical direction in FIG. 33 though the slide members r5 and r5' which are fitted in and guided by the guide slots r7 and r7' formed in the guide blocks r6 and r6', whereby the old and new slivers s, s' nipped between those piecing members are rubbed and thereby bonded together.

Numeral r18 denotes a lever generally L-shaped in plan and which is pivotally mounted at one end thereof on a horizontal shaft r19 disposed in the sliver piecing body r1, with a nipping member r20 being disposed at the opposite, or front, end of the lever r18.

The nipping member r20 comprises a movable nipping lever r22 supported at one end pivotally by a pin r21 and a fixed nipping lever r22' disposed along the front end portion of the lever r18. The movable nipping lever r22 is biased for pivotal movement toward the fixed nipping lever r22' by means of a spring member such as a coiled spring (not shown) disposed around the pin r21.

Numeral r24 denotes a wire, one end of which is connected to the movable nipping lever r22 and the opposite end of which is connected to a swing lever r26, the swing lever r26 being moved by one of known cams (not shown) pivotally about a vertical shaft r25 erected on the sliver piecing body r1. The wire r24 is stretched so as not to be an obstacle to other members by means of guide rollers r23 and r23' which are disposed in suitable positions of the lever r18, etc.

By turning the swing lever r26 clockwise in FIG. 33 about the vertical shaft r25, the wire r24 is pulled, thus causing the movable nipping lever r22 which is in its closed position to turn clockwise about the pin r21 to open the nipping member r20.

Conversely, by turning the swing lever r26 in the direction opposite to the above direction, the movable nipping lever r22 is turned toward the fixed nipping lever r22' by virtue of the spring member, whereby it is made possible to nip the old and new slivers s, s' which will be described later.

On the other hand, the lever r18 with the nipping member r20 attached to the front end portion thereof is pivotally mounted on the horizontal shaft r19 disposed in the sliver piecing body r1, as mentioned previously, so can be turned in a direction nearly perpendicularly to the paper surface of FIG. 33 about the horizontal shaft r19 by the use of a suitable drive means such as cam means (not shown).

Numeral r27 denotes a fixing nip member disposed in a vertical portion of a suitable frame of the sliver piecing body r1 in a nipping relation to the sliver piecing position in the sliver piecing body device R. By the use of a suitable means such as cam means, the fixing nip member r27 can be turned from its vertical position shown in FIG. 33 up to its abutment with a fixed nipping base r29 disposed in the sliver piecing body r1 around a pin r28 erected on a suitable frame of the body r1. In FIG. 33 there are shown only the fixing nip member r27 and fixed nipping base r29 which are located in upper positions, while a fixing nip member r30 and a fixed nipping base r31 which are located in lower positions are not shown, though shown in FIGS. 35 and 36 to be referred to later.

Figure 34:
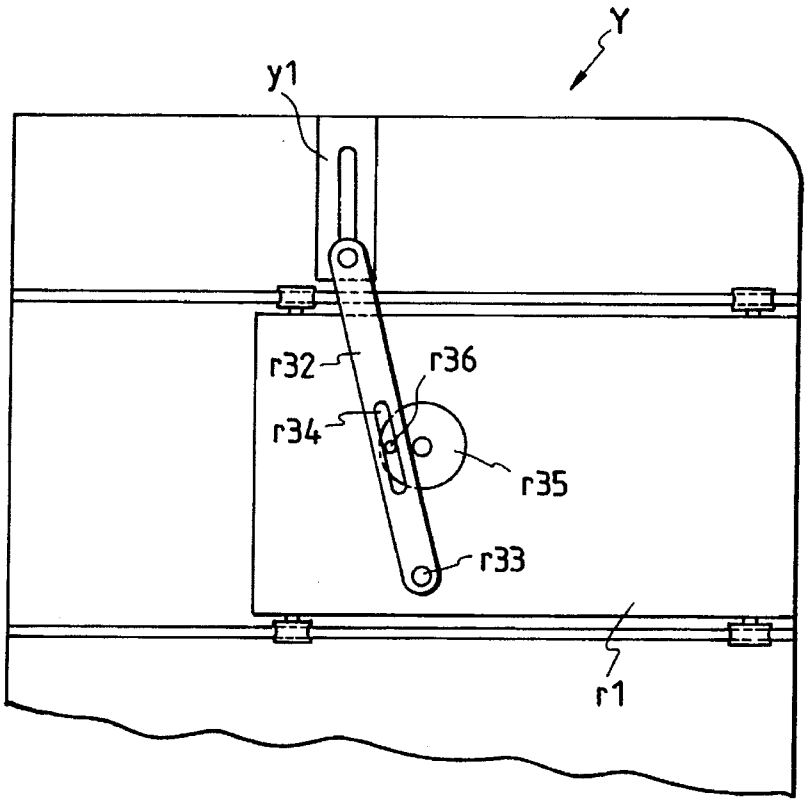
FIG. 34 is a schematic plan view of a sliver piecing body device for explaining a sliver piecing body moving device.

The following description is now provided about a sliver piecing body moving device Y with reference to FIG. 34 which is a schematic plan view of the sliver piecing body device R.

Numeral r32 denotes a lever, one end of which is pivotally mounted on a vertical shaft r33 erected on the sliver piecing body r1 and the opposite end of which is slidably fitted through a sliding block or the like in a slide member y1 fixed to the base of the sliver piecing body device R.

In a nearly middle portion of the lever r32 there is formed an axially extending, elongated hole r34, in which is fitted a pin r36 of a cam r35 disposed in the sliver piecing body r1.

Therefore, by rotating the cam r35 using a suitable drive means such as a motor (not shown) to turn the lever r32 transversely in FIG. 34 about the vertical shaft r33 erected on the sliver piecing body r1, the sliver piecing body r1 can be moved transversely in FIG. 34.

Without forming the elongated hole r34 in the lever r32, the lever r32 may be turned by abutment of the cam r35 with a cam follower attached to the lever r32.

The sliver piecing operation of the sliver piecing body device R will be described below with reference to FIGS. 35 to 41 which are enlarged perspective views of a principal portion of the device R, showing the operation thereof.

Figure 35:
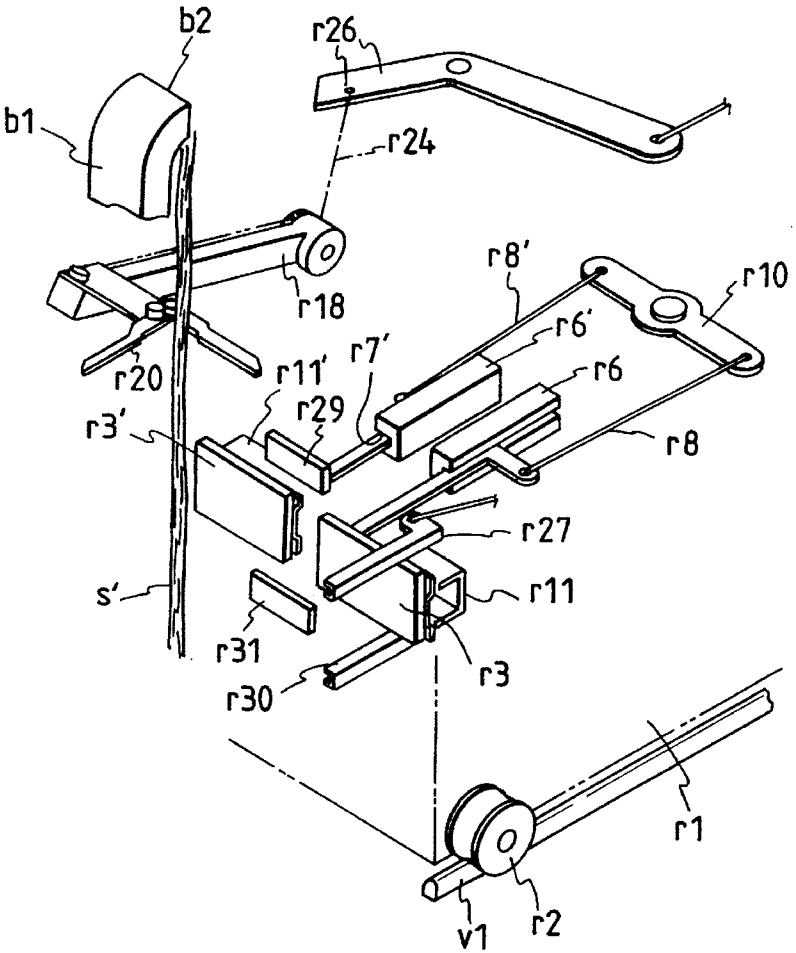
FIG. 35 is an enlarged perspective view of a principal portion of the sliver piecing body device, showing a sliver piecing operation.

In the state illustrated in FIG. 35, as in FIG. 31, an end portion of the new sliver s' depending from an edge of the full-loaded can F' has been sucked in through the suction hole b2 of the suction arm b1, and the suction arm b12 thereafter turned to a nearly vertical upper position by operation of the motor b4 capable of rotating forward and reverse.

Figure 36:
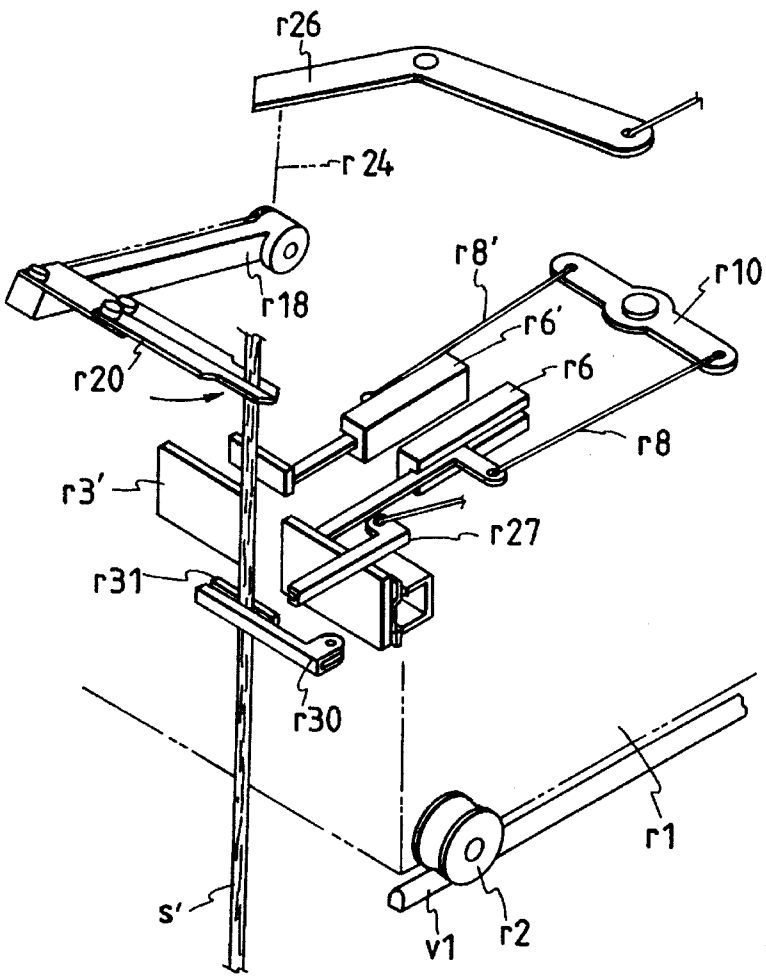
FIG. 36 is a view similar to FIG. 35, showing a similar sliver piecing operation.

In this state, as shown in FIG. 36, the lower, fixing nip member r30 is turned to nip in cooperation with the fixed nipping base r31 the new sliver s' which has been sucked into the suction hole b2 of the suction arm b1. At the same time, the swing lever r26 and the lever r18 with the nipping member r20 attached thereto are operated suitably, thereby causing the nipping member r20 to nip the new sliver s' in a position above the piecing members r3 and r3'.

Figure 37:
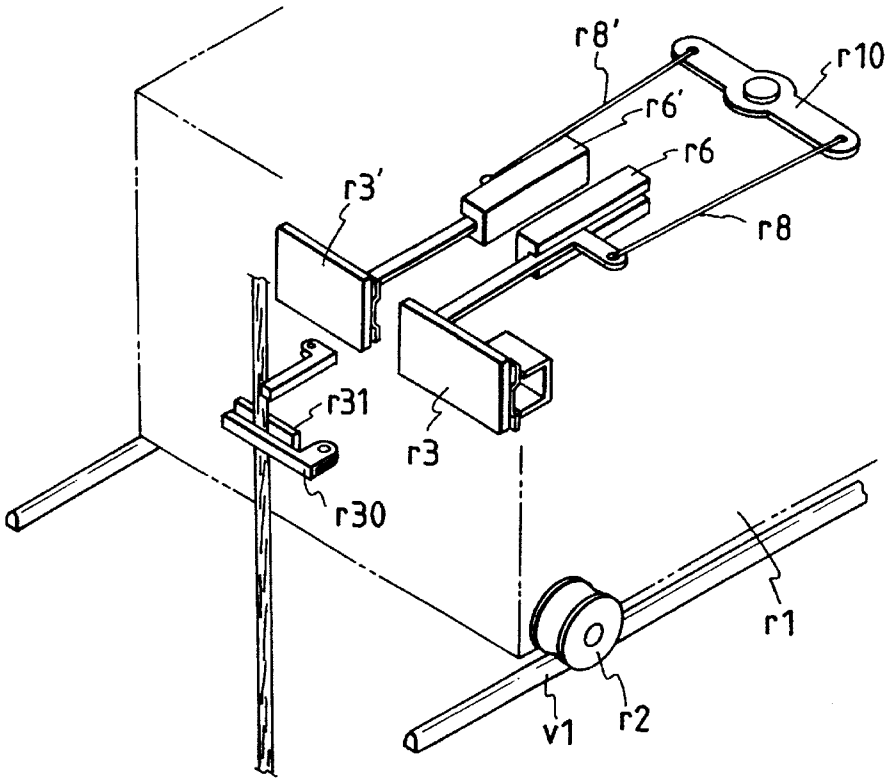
FIG. 37 is a view similar to FIG. 35, showing a similar sliver piecing operation.

Thereafter, with the new sliver s' nipped by the nipping member r20, the lever r18 is turned upward to cut the new sliver s', as shown in FIG. 37.

After the cutting, the new sliver s' is held grippingly between the fixing nip member r30 and the fixed nipping base r31, and the swing lever r26 and the nipping member r20 are returned to their stand-by positions, as shown in FIG. 37.

The new sliver s' portion which has become unnecessary after the cutting is sucked into the suction hole b2 and is conducted into a dust box incorporated in the new sliver end transfer device B.

The above process of forming a sliver piecing end of the new sliver s' and transferring it to the sliver piecing position is carried out prior to forming a sliver piecing end of the old slivers which will be described later.

Next, the old slivers which has been drawn up to the driving roller u3 side by means of the sliver draw-up member u1 and draw-up roller u2, nipped between the roller u2 and the driving roller u3 and slackened a predetermined length between the sliver guide g and the roller u2, is conveyed up to the sliver piecing position in the sliver piecing body device R by means of the transfer hook t10 of the sliver transfer device T.

Figure 39:
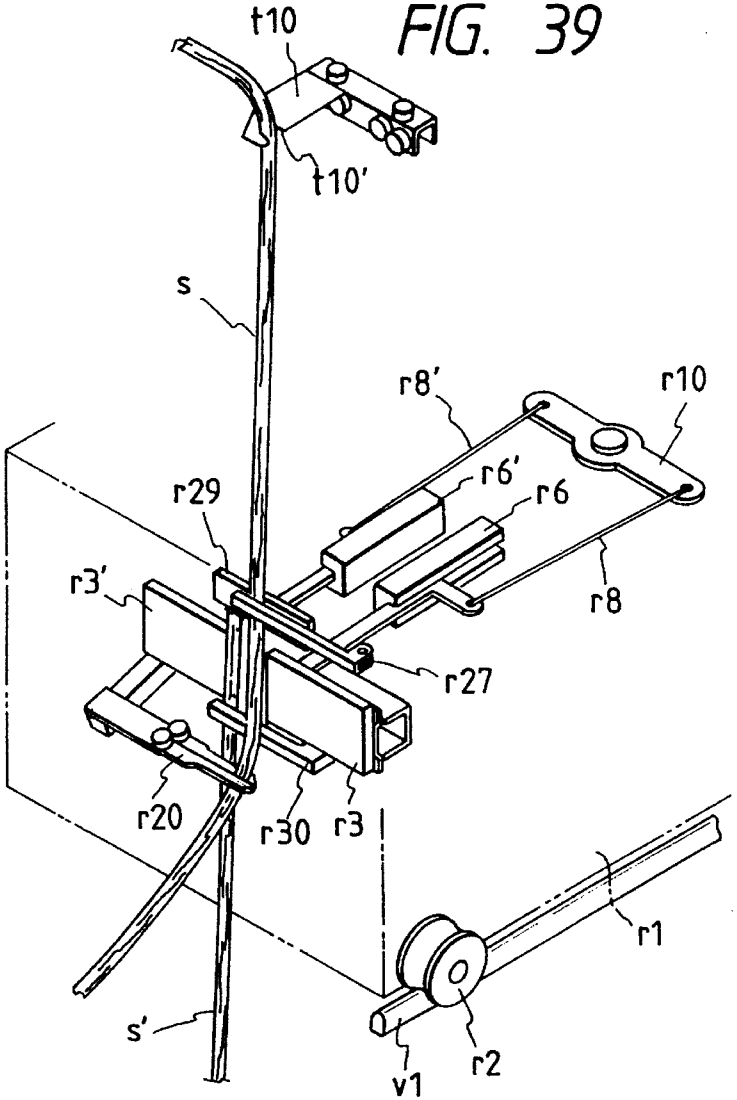
FIG. 39 is a view similar to FIG. 35, showing a similar sliver piecing operation.
Figure 38:
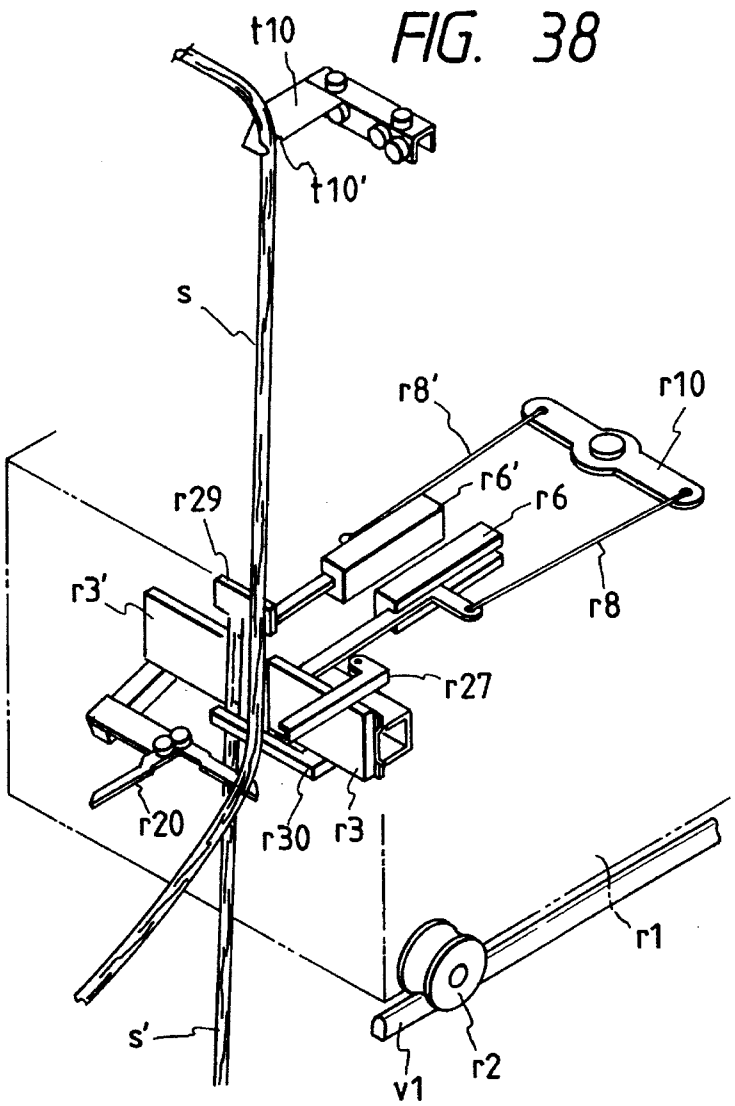
FIG. 38 is a view similar to FIG. 35, showing a similar sliver piecing operation.

In this state, as shown in FIG. 39, the upper, fixing nip member r27 is turned to nip the old sliver s between it and the fixed nipping base r27.

Then, the swing lever r26 and the lever r18 with the nipping member r20 attached thereto are operated suitably to nip the old slivers in the nipping member r20 in a position below the piecing members r3 and r3'. At the same time, with the old slivers nipped by the nipping member r20, the lever r18 is turned downward to cut the old slivers.

After the cutting, the old slivers is held grippingly between the fixing nip member r27 and the fixed nipping base r29, and the swing lever r26 and the nipping member r20 are returned to their stand-by positions, as shown in FIG. 39.

Figure 40:
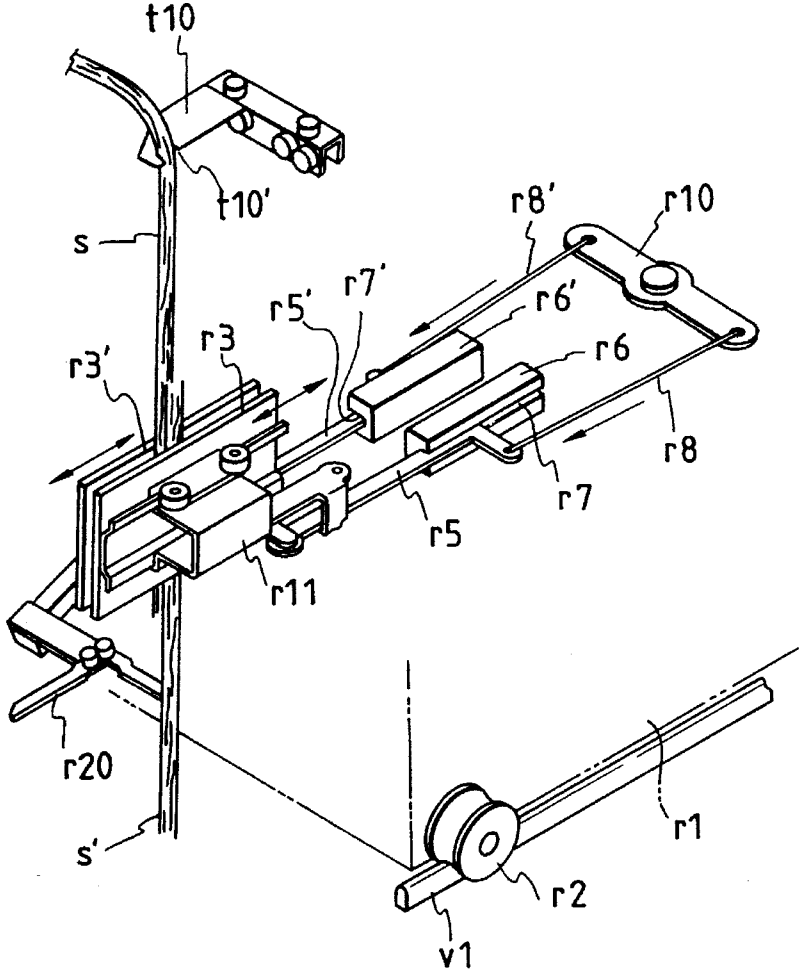
FIG. 40 is a view similar to FIG. 35, showing a similar sliver piecing operation.

With the new and old slivers s', s having been cut and the respective cut ends for coupling positioned between the piecing members r3 and r3', the presser members r11 and r11' are turned, as shown in FIG. 40, thereby causing the piecing members r3 and r3' to approach each other through the rotating rollers r12, r12', r13 and r13' to nip the old and new slivers s, s' therebetween.

In FIG. 40, the fixing nip member r30 and fixed nipping base r31 which hold the new sliver s' and the fixing nip member r27 and fixed nipping base r29 which hold the old slivers are omitted.

Thereafter, the lever r10 is allowed to swing using a suitable drive means, whereby the piecing members r3 and r3' are fitted together in an alternate manner through the slide members r5 and r5' which are fitted in and guided by the guide slots r7 and r7' formed in the guide blocks r6 and r6', respectively, to rub and thereby bond together the old and new slivers s, s' which are nipped between the piecing members r3 and r3'.

Figure 41:
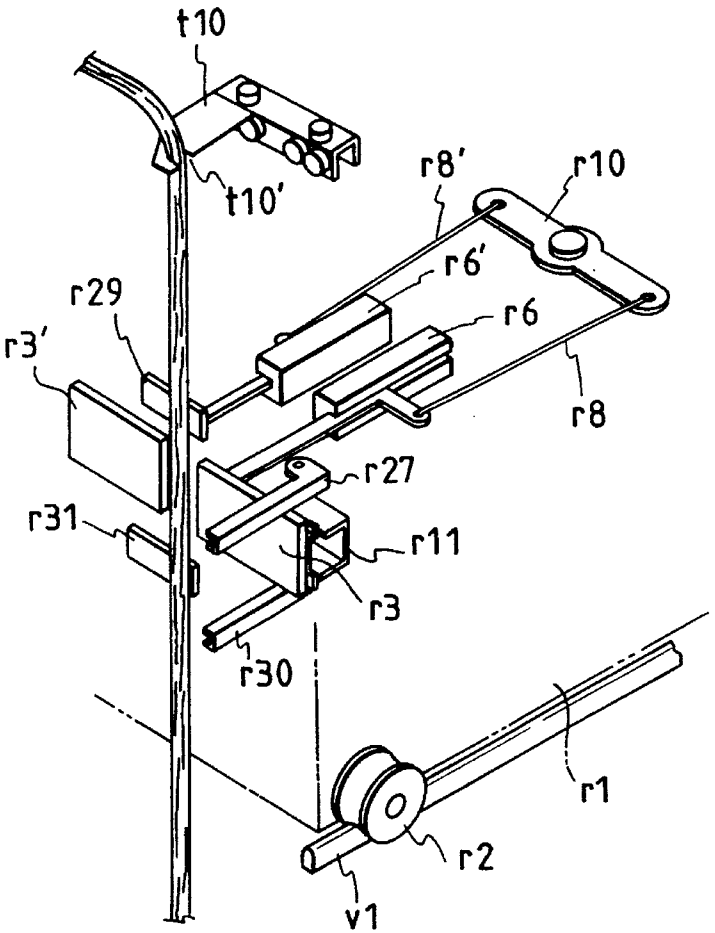
FIG. 41 is a view similar to FIG. 35, showing a similar sliver piecing operation.

After the old-new sliver piecing operation is over, the piecing members r3 and r3' are opened like their original stand-by state, and the old and new slivers s, s' are released from their gripped state by turning the fixing nip members r27 and r30, as shown in FIG. 41. Thus, all the operating members, including those just mentioned, are returned to their stand-by positions.

Next, the sliver piecing body device R is retreated by operating the sliver piecing body moving device Y.

The sliver piecing process by the sliver piecing body device R is completed through the operations described above.

Thereafter, in synchronism with the movement of the full-loaded cans F1 and F2 in the spinning frame S direction, as noted previously, the motors t8 and t25 are driven to turn the transfer hooks t11 and t23 clockwise in FIG. 29, and in this state the full-loaded cans F1 and F2 after completion of the piecing of slivers are carried into the rows of cans in the spinning frame S.

In this way, the sliver piecing work between old and new slivers s, s' from empty can E and full-loaded can F, respectively, as well as the E-F changing work, are completed.

Functions and effects of the above embodiment of the present invention are as follows.

By slackening the slivers from empty cans, the sliver piecing work can be done without stopping the spinning unit concerned, whereby not only the drive controller for the spinning machine can be simplified but also the operation efficiency of the spinning machine can be improved.

Since a pair of sliver piecing body devices are disposed on the cans exchanging carrier to effect piecing of slivers between two empty cans and two full-loaded cans at a time, the sliver piecing work can be done quickly, with the result that the time required for sliver piecing is shortened and hence the operation efficiency of the spinning is improved.

Since the sliver piecing work can be done for the rows of cans arranged in any of adjacent spinning machines without the necessity of considering the directionality of the cans exchanging carrier, etc., the operability of the cans exchanging carrier and workability are improved.

Since the piecing members which hold old and new slivers grippingly, and the vertically disposed fixing nip members and fixed nipping bases nipping old or new sliver, are in a nearly orthogonal relation, the positioning of the old and new slivers with respect to the sliver piecing position in the sliver piecing body device is effected accurately, thus ensuring the piecing of the slivers.

Since the old sliver is made slack using a roller, it is easy to control the sliver drawing-out speed from the empty cans, the degree of slack, etc. and hence it is possible to make an appropriate sliver piecing control.

Since old and new slivers from empty and full-loaded cans, respectively, are pieced together while both empty and full-loaded cans are carried on the cans exchanging carrier, the sliver piecing work can be done if only the spacing between adjacent spinning machines permits entry of the cans exchanging carrier, so it is possible to dispose a larger number of spinning machines without enlarging the space.

The following effect can be attained by the present invention having the construction described above.

Since the slivers from sliver feeding cans to a spinning machine and the slivers from full-loaded cans are pieced together while both such cans are carried on the cans exchanging carrier, the sliver piecing work can be carried out even when the spacing between adjacent spinning machines is narrow and hence a larger number of spinning frames can be disposed without enlarging the space.

What is claimed is:

1. A cans exchanging system, comprising:

a plurality of cans arranged in an array with a plurality of rows in the longitudinal direction of a spinning machine and a plurality of columns in a direction orthogonal to the longitudinal direction of the spinning machine, one of said columns being empty cans arranged in the direction orthogonal to the longitudinal direction of the spinning machine, means for carrying out simultaneously said empty cans in said one of said columns, a plurality of full-loaded cans, and means for carrying in simultaneously said plurality of full-loaded cans to said one column which was the carried-out position of the empty cans.

2. A cans exchanging system as claimed in claim 1, further including sliver guides disposed above and provided for each of said cans arranged in said array of rows and a single sliver guide shaft disposed in the longitudinal direction of the spinning machine upon which said sliver guides are mounted.

3. A cans exchanging system as claimed in claim 2, wherein said single sliver guide shaft disposed in the longitudinal direction of the spinning machine upon which said sliver guides are mounted is disposed above a substantially middle portion between adjacent said cans in each of said columns.

4. A cans exchanging system, comprising:

a plurality of cans arranged in a plurality of rows in the longitudinal direction of a spinning machine, a plurality of empty cans arranged in a direction orthogonal to the longitudinal direction of the spinning machine, means for carrying out simultaneously a plurality of said plurality of empty cans, a plurality of full-loaded cans, means for carrying in simultaneously said plurality of full-loaded cans to a carried-out position of the empty cans, and means for forming a gap between said empty cans and a floor and a can transfer device which is inserted into the gap to take out the empty cans.

5. A cans exchanging system as claimed in claim 4, wherein said means for forming a gap is a tilting means wherein a plurality of said plurality of said empty cans arranged in a direction orthogonal to the longitudinal direction of the spinning machine are tilted to form said gap between the tilted cans and the floor, and wherein said can transfer device is insertable into said gap between the tilted cans and the floor, and wherein after the cans are moved back from the tilted state to the original state, said can transfer device is able to be drawn out in the direction orthogonal to the longitudinal direction of the spinning machine.

6. A cans exchanging system as claimed in claim 5, wherein said can transfer device comprises a can resting member and a moving member disposed below the can resting member, and said can resting member and said moving member are movable in a direction orthogonal to the longitudinal direction of a spinning machine.

7. A cans exchanging system as claim in claim 5, wherein said can resting member and said moving member are movable telescopically in a direction orthogonal to the longitudinal direction of a spinning machine, and means for moving aid can transfer device down along downwardly inclined guide rails toward the spinning machine.

8. A cans exchanging system as claimed in claim 5, wherein said can transfer device includes a tilting member, an intermediate moving member disposed on the tilting member and a can resting member disposed on the intermediate moving member, and a rack member attached to the intermediate moving member which is engaged with a chain disposed on the tilting member.

9. A can exchanging system as claimed in claim 8, wherein a plurality of spinning machines are installed, a tilting means for tilting said tilting member is attached to the can transfer device, and said can transfer device is capable of being moved to anywhere along a spinning machine adjacent thereto.

10. A cans exchanging system as claimed in claim 5, wherein said cans exchanging system further includes a can presser member capable of moving forward and backward in a direction orthogonal to the longitudinal direction of the spinning machine.

11. A can exchanging system as claimed in claim 10, wherein said can presser member includes a pair of urging members capable of rising and falling, transferring members to which said urging members are mounted, and a common drive source for synchronously driving said transferring members.

12. A sliver piecing method characterized in that a can which is feeding sliver to a spinning machine and a full-loaded can are placed on a cans exchanging carrier provided with a sliver piecing device, and the sliver from the sliver feeding can and that from the full-loaded can are pieced together on the cans exchanging carrier.

13. A sliver piecing method, comprising the steps of:

drawing out a predetermined amount of an old sliver from a can which is feeding sliver to a spinning machine, then slackening said old sliver from said old can, and thereafter piecing together said old sliver from said can and a new slaver from a full-loaded can.

14. A silver piecing system, comprising:

an old silver from a can which is feeding sliver to a spinning machine, a new sliver from a full-loaded can on a cans exchanging carrier provided with a sliver piecing device, means for drawing out and slackening said old sliver from the sliver feeding can on the cans exchanging carrier prior to piecing the old and new sliver with the sliver piecing device.

15. A sliver piecing system, comprising:

an old sliver from a can which is feeding sliver to a spinning machine, a new sliver from a full-loaded can on a cans exchanging carrier provided with a sliver piecing device, means for drawing out and slackening said old sliver from the sliver feeding can on the cans exchanging carrier prior to piecing the old and new sliver with the sliver piecing device; and wherein said sliver piecing means includes piecing members for nipping said old sliver from said can which is feeding sliver to the spinning machine and said new sliver from said full-loaded can, and fixing nip members and fixed nipping bases each arranged in the vertical direction and nipping said old sliver from the sliver feeding can and said new sliver from the full-loaded can; said piecing member, said fixing member and said fixed nipping base being positioned approximately orthogonal to each other in the respective longitudinal directions.

16. A sliver piecing system, comprising:

an old sliver from a cam which is feeding sliver to a spinning machine, new sliver from a full-loaded can on a cans exchanging carrier provided with a sliver piecing device, means for drawing out and slackening said old sliver from the sliver feeding can on the cans exchanging carrier prior to piecing the old and new sliver with the sliver piecing device; and wherein said means for drawing out and slackening the old sliver includes a sliver guide, a sliver draw-up member, and a draw-up roller which is disposed at an end portion of the sliver draw-up member, said sliver draw-up member being hold between rollers driven by a motor capable of rotating forward and reverse.

* * * * *